US009287623B2

(12) United States Patent
Lindenmeier et al.

(10) Patent No.: US 9,287,623 B2
(45) **Date of Patent: *Mar. 15, 2016**

(54) ANTENNA FOR RECEPTION OF CIRCULARLY POLARIZED SATELLITE RADIO SIGNALS

(71) Applicant: Delphi Deutschland GmbH, Wuppertal (DE)

(72) Inventors: Stefan Lindenmeier, Gauting-Buchendorf (DE); Heinz Lindenmeier, Planegg (DE); Jochen Hopf, Haar (DE); Leopold Reiter, Gilching (DE)

(73) Assignee: Delphi Deutschland GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/827,097

(22) Filed: Mar. 14, 2013

(65) Prior Publication Data

US 2014/0203979 A1 Jul. 24, 2014

Related U.S. Application Data

(62) Division of application No. 12/875,101, filed on Sep. 2, 2010, now Pat. No. 8,599,083.

(51) Int. Cl.

| | |
|---|---|
| ***H01Q 7/00*** | (2006.01) |
| ***H01Q 21/24*** | (2006.01) |
| ***H01Q 3/30*** | (2006.01) |
| ***H01Q 21/28*** | (2006.01) |

(52) U.S. Cl.

CPC . *H01Q 7/00* (2013.01); *H01Q 3/30* (2013.01); *H01Q 21/24* (2013.01); *H01Q 21/28* (2013.01)

(58) Field of Classification Search

CPC ..... H01Q 7/00; H01Q 21/28; H01Q 3/30; H01Q 21/24

USPC ..... 343/741, 742, 743, 744, 866, 867, 870, 343/732, 876

See application file for complete search history.

(56) References Cited

U.S. PATENT DOCUMENTS

| | | | | |
|---|---|---|---|---|
| 5,977,921 | A | 11/1999 | Niccolai et al. | |
| 8,599,083 | B2 * | 12/2013 | Lindenmeier et al. | 343/744 |
| 2003/0063038 | A1 | 4/2003 | Nakano et al. | |

(Continued)

FOREIGN PATENT DOCUMENTS

| | | |
|---|---|---|
| EP | 0439677 | 8/1991 |

(Continued)

OTHER PUBLICATIONS

Nakano, H. et al.: "Mesh Antennas for Dual Polarization", IEEE Transactions on Antennas and Propagation, IEEE Service Center, Piscataway, NJ, US, Bd. 49, Nr. 3, Mar. 3, 2001, SP011004036, ISSN: 0018-936X.

*Primary Examiner* — Dieu H Duong

(57) ABSTRACT

An antenna for receiving circularly polarized satellite radio signals has a conductive base surface and at least one a conductor loop oriented horizontally above the base surface by a height h. The conductor loop is configured as a polygonal or circular closed ring line radiator. The ring line radiator forms a resonant structure that is electrically excited so that the current distribution of a running line wave in a single rotation direction occurs on the ring line, wherein the phase difference of which, over one revolution, amounts to essentially 2π. A vertical radiator extends between the conductive base surface and the circumference of the ring line radiator. The height h is smaller than ⅕ of the free-space wavelength λ.

7 Claims, 25 Drawing Sheets

(56) References Cited

U.S. PATENT DOCUMENTS

| | | | |
|---|---|---|---|
| 2003/0174098 | A1 | 9/2003 | Noro et al. |
| 2009/0046026 | A1 | 2/2009 | Nakano et al. |
| 2010/0253587 | A1 | 10/2010 | Lindenmeier et al. |

FOREIGN PATENT DOCUMENTS

| | | |
|---|---|---|
| EP | 1986269 | 10/2008 |
| EP | 2226895 | 9/2010 |
| GB | 1105354 | 3/1968 |

* cited by examiner

ANTENNA FOR RECEPTION OF CIRCULARLY POLARIZED SATELLITE RADIO SIGNALS

RELATED APPLICATIONS

The present application is a Divisional application of U.S. Ser. No. 12/875,101 filed 2 Sep. 2010.

The present application is related to U.S. Patent Publication No. 2013/0257678 (U.S. Ser. No. 13/826,875 filed on 14 Mar. 2013), entitled "Antenna for reception of circularly polarized satellite radio signals", also claiming priority to U.S. Ser. No. 12/875,101 filed 2 Sep. 2010.

BACKGROUND

One embodiment of the invention relates to an antenna for reception of circularly polarized satellite radio signals.

With satellite radio systems, what is important is the efficiency of the transmission output emitted by the satellite, and the efficiency of the reception antenna. Satellite radio signals are generally transmitted with circularly polarized electromagnetic waves, because of polarization rotations on the transmission path. In many cases, program contents are transmitted, for example, on separate frequency bands that lie close to one another in frequency. This is done, using the example of SDARS satellite radio, at a frequency of approximately 2.33 GHz, in two adjacent frequency bands, each having a bandwidth of 4 MHz, at a distance between the center frequencies of 8 MHz. The signals are emitted by different satellites, with an electromagnetic wave that is circularly polarized in one direction. Accordingly, circularly polarized antennas are used for reception in the corresponding direction of rotation. Such antennas are known, for example, from DE-A-4008505 and DE-A-10163793 which was also published as U.S. Pat. No. 6,653,982 on Nov. 25, 2003, the disclosure of which is hereby incorporated by reference in its entirety. This satellite radio system is additionally supported by means of the transmission of terrestrial signals, in certain areas, in another frequency band having the same bandwidth, disposed between the two satellite signals. Similar satellite radio systems are currently in a planning stage. The satellites of the Global Positioning System (GPS) also emit waves that are circularly polarized in one direction, at a frequency of about 1575 MHz, so that the aforementioned antenna shapes can fundamentally be configured for this service.

The antenna known from DE-A-4008505 is built up on a conductive base surface that is essentially or substantially oriented horizontally, and consists of crossed horizontal dipoles having dipole halves that consist of linear conductor parts inclined downward in V shape, which are mechanically fixed in place at an azimuthal angle of 90 degrees, relative to one another, and are affixed at the upper end of a linear vertical conductor attached to the conductive base surface. The antenna known from DE-A-10163793 is also built up above a conductive base surface that is generally oriented horizontally, and consists of crossed frame structures that are mounted azimuthally at 90° relative to one another. With both antennas, in order to produce the circular polarization, the antenna parts that are spatially offset by 90° relative to one another, in each instance, are interconnected and shifted by 90° relative to one another in terms of the electrical phase.

It is true that both antenna shapes are suitable for reception of satellite signals that are emitted by high-flying satellites—so-called HEOS. By means of an increase in the cross-polarization suppression in an elevation angle range that is as great as possible, however, the reception of temperature noise can be clearly reduced, in comparison with the reception of the satellite signals.

In addition, there is the difficulty of forming antennas having a smaller construction volume, which is compulsory for mobile applications, in particular. As further antennas of this type, patch antennas are known, according to the state of the art, but these are also less powerful with regard to reception at low elevation angles, and because of the use of dielectric materials, they demonstrate losses that clearly impair the signal-to-noise ratio.

For reception of all the radio services mentioned, however, efficiency in production of the antennas, which are produced in large volume, is of decisive importance.

For the production of antennas that are known from DE-A-4008505 and DE-A-10163793, there are problems resulting from the situation that the individual antenna parts are placed on planes that intersect at a right angle, and that these planes additionally stand perpendicular on the conductive base plane. Such antennas cannot be produced in sufficiently economically efficient manner, as desired, for example, for use in the automobile industry. This particularly holds true for the frequencies of several gigahertz that are usual in the case of satellite antennas, for which particularly great mechanical precision is required in the interests of polarization purity, impedance adaptation, and reproducibility of the directional diagram in the mass production of the antennas. Likewise, the production of patch antennas is generally relatively complicated, due to the close tolerances of the dielectric.

SUMMARY

It is therefore the task of the one embodiment of the invention to indicate an antenna having a low construction volume, or size. This antenna depending on its design, is suitable not only for particularly high-power reception of satellite signals that are emitted circularly polarized in a direction of rotation, and come in at high elevation angles, with great gain in the vertical direction, but also for high-power reception of satellite signals that are circularly polarized in a direction of rotation, and come in at low elevation angles, with great cross-polarization suppression over a great elevation angle range. In particular, another task is the goal of the possibility of economically efficient production.

These tasks are accomplished, through an antenna1 for reception of circularly polarized satellite radio signals. This antenna can comprise at least one conductive base surface and at least one conductor loop oriented horizontally above the conductive base surface, wherein the conductor loop is configured as a ring line radiator, by means of a polygonal or circular closed ring line, in an essentially or substantially horizontal plane having the height h, running above the conductive base surface. There can also be an arrangement for an antenna feeder forming an electromagnetic excitation of the conductor loop. In addition, there can be an antenna connector coupled to the arrangement for electromagnetic excitation. In at least one embodiment, the ring line radiator forms a resonance structure that is electrically excited by means of the electromagnetic excitation, so that the current distribution of a running line wave in a single rotation direction occurs on the ring line, wherein the phase difference of which, over one revolution, amounts to essentially or substantially $2\pi$. There can also be at least one vertical radiator which runs toward the conductive base surface which is disposed on a circumference of the ring line radiator, wherein the vertical radiator is electromagnetically coupled both with the ring line radiator and with the electrically conductive base surface, to support the vertically oriented component of the electromagnetic field. In this case, the height h is smaller than ⅕ of the free-space wavelength λ.

The advantage of allowing reception also of linearly vertically polarized waves, received at low elevation, having an azimuthally almost homogeneous directional diagram, is connected with an antenna according to the one embodiment of the invention. Another advantage of an antenna according to one embodiment of the invention is its particularly simple producibility, which allows implementation also by means of simple, bent sheet-metal structures.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1A:
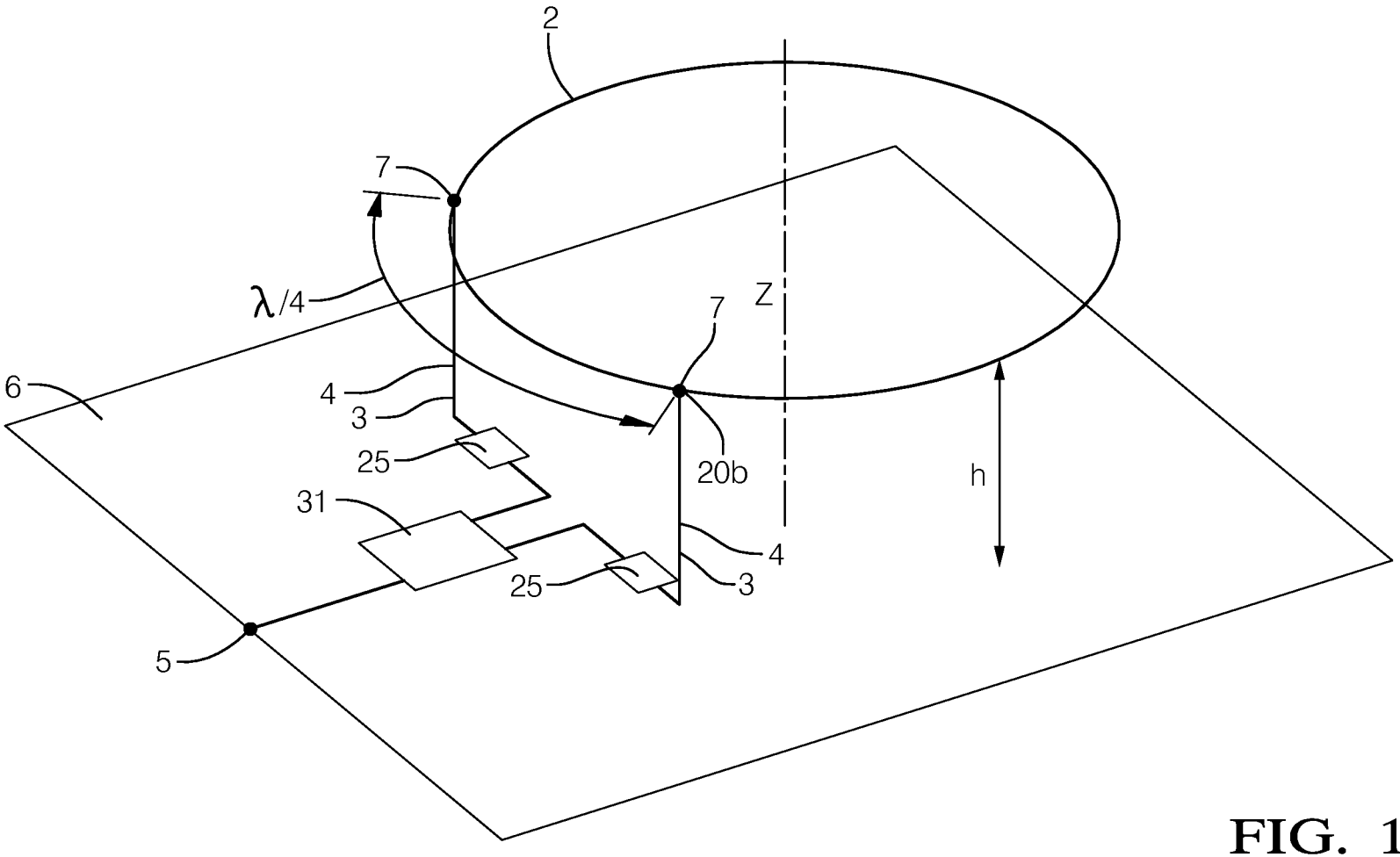
FIG. 1A is a perspective view of a first embodiment of an antenna.

Below is a brief description of the different Figures. For example, FIG. 1A is a perspective view of one antenna according to one embodiment of the invention, having a circular ring line radiator 2, structured as a resonance structure, for production of a circularly polarized field having an azimuthally dependent phase. There is an antenna feeder formed as an electromagnetic excitation 3, which is produced by feeding in signals at λ/4 ring line coupling points 7, spaced apart from one another. These signals differ in phase by 90°, to produce a running wave over the circumference of the line. Vertical radiators are configured to support of vertical components of the electrical radiation field.

Figure 1B:
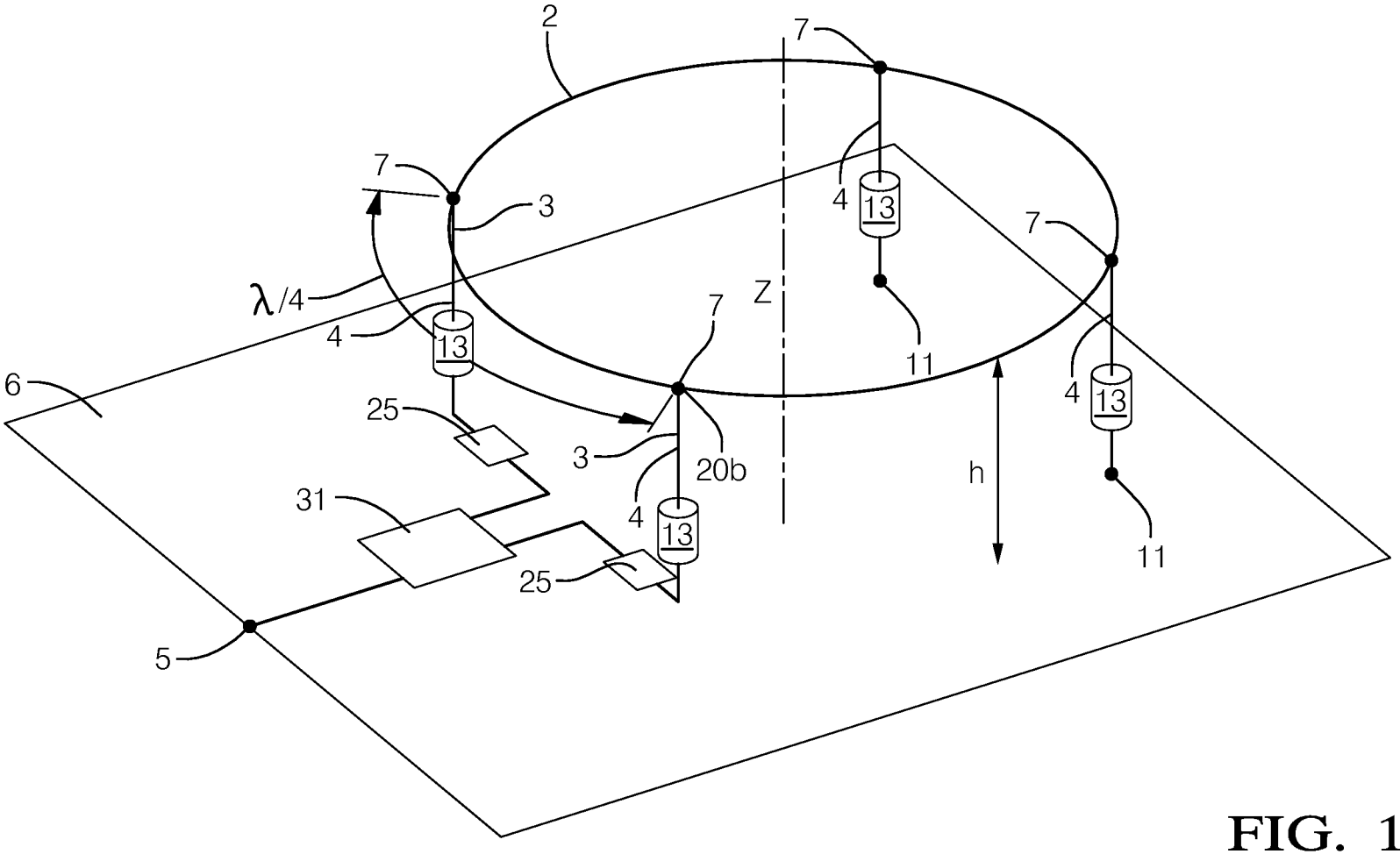
FIG. 1B is a side perspective view of another embodiment of the antenna.

FIG. 1B is similar to the view shown in FIG. 1A, but with additional vertical radiators 4, which are connected, at an interruption point, in each instance, with a low-loss reactance circuit 13 of the reactance X.

Figure 2A:
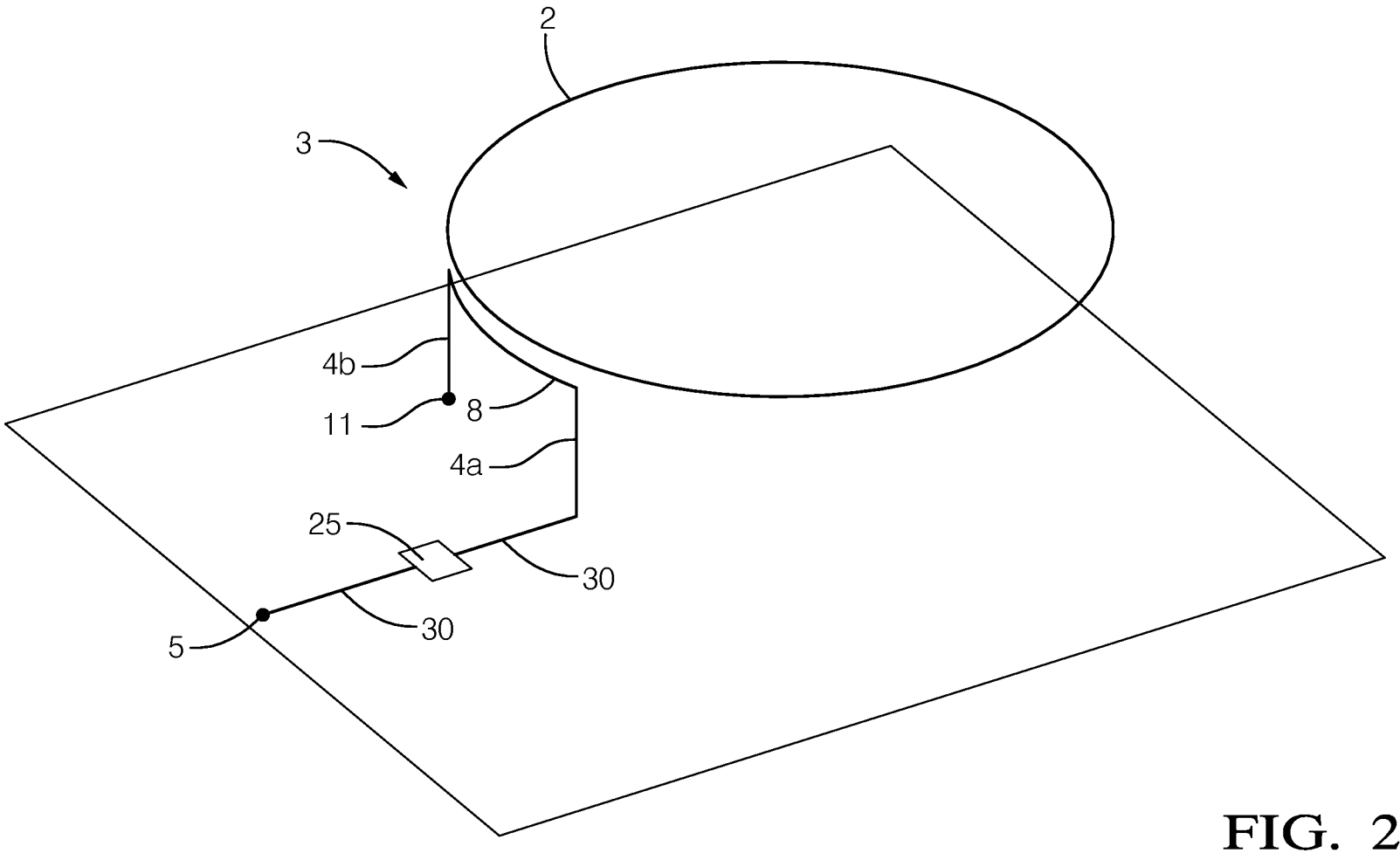
FIG. 2A is a side perspective view of an antenna similar to the antenna shown in FIG. 1A with a ring line radiator.

FIG. 2A is a side perspective view of an antenna as shown in FIG. 1A, but for production of the continuous line wave, at an advantageous distance with regard to the line wave resistance with λ/4-directional coupling conductor 8 guided parallel to the ring line radiator 2. In this embodiment a wave resistance for directional coupling should be in an ordinary range such as for example 50 ohms, or at least between 20 and 100 ohms. Therefore, the advantageous distance would be a distance which produces between 20 and 100 ohms or in at least one embodiment substantially 50 ohms.

Figure 2B:
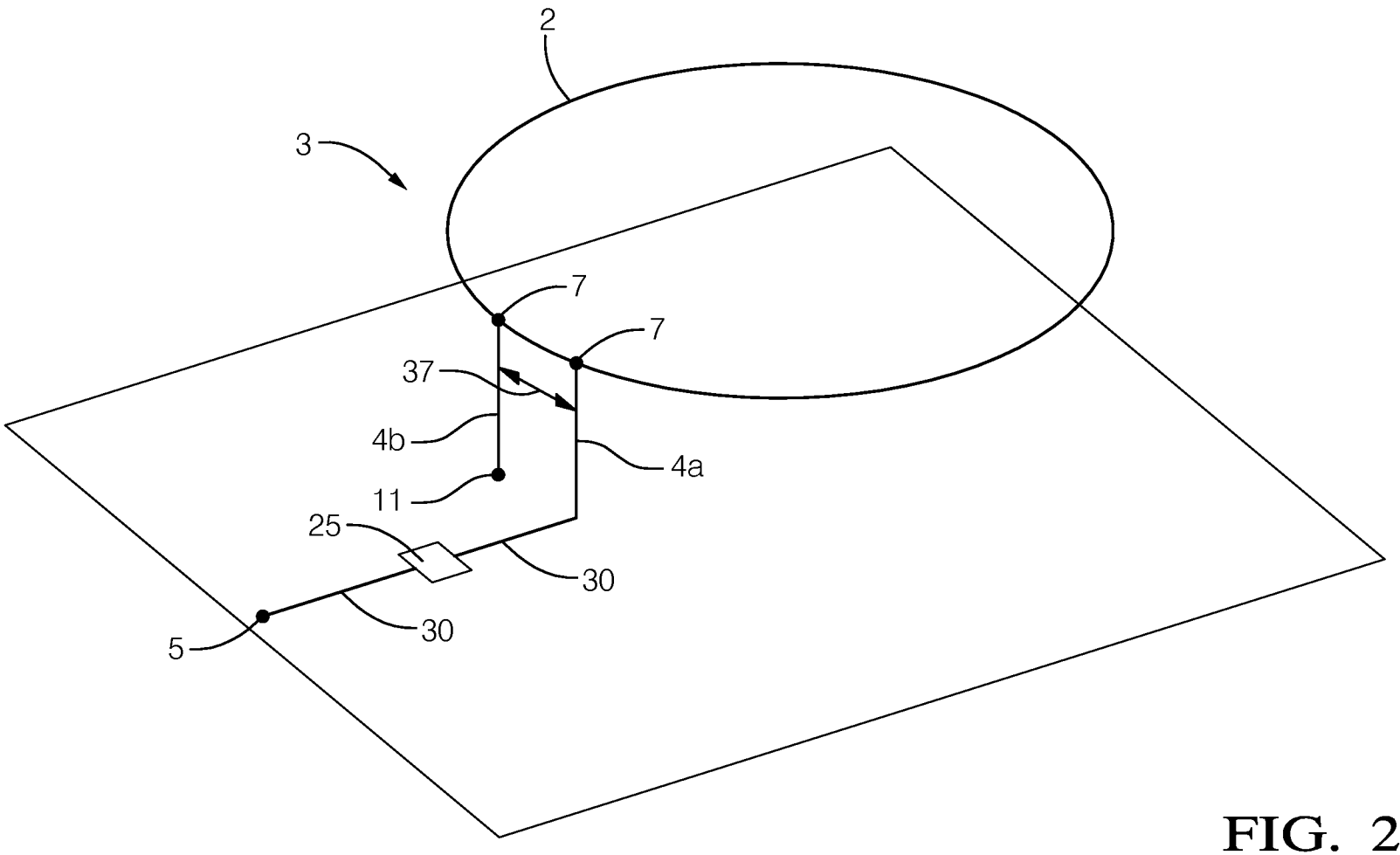
FIG. 2B is a side perspective view of another embodiment of an antenna.

FIG. 2B is an antenna as in FIG. 1A, but having two essentially or substantially vertical radiators 4, which are spaced apart at a small distance 37, with reference to the ¼-line wavelength, radiator 4*a*, which is guided in parallel.

Figure 3:
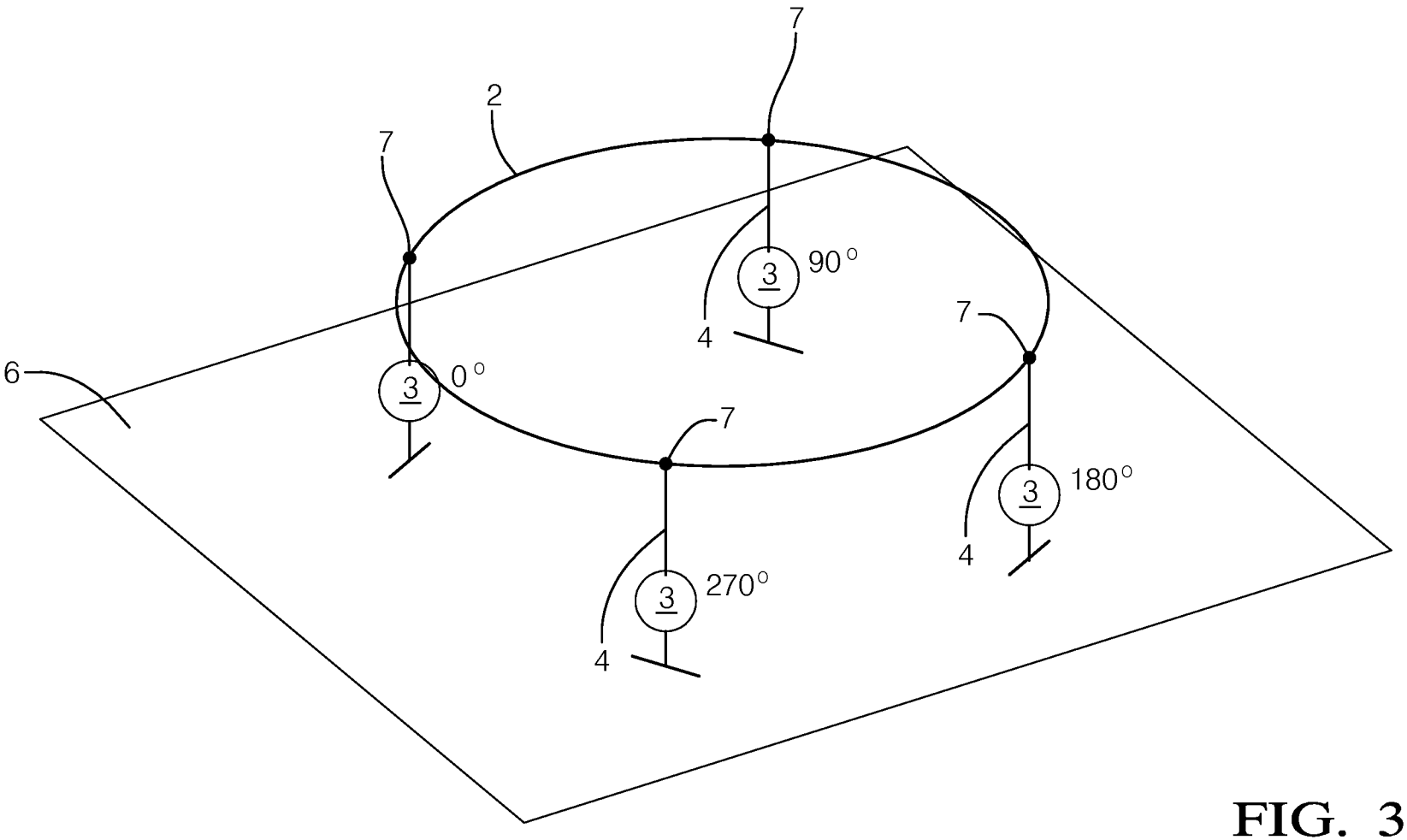
FIG. 3 is a side perspective view of another embodiment of an antenna.

FIG. 3 is a ring line radiator 2, but having an antenna feeder or electromagnetic excitation 3 at four ring line coupling points 7, offset by λ/4 along the ring line, in each instance, by means of the signals of the feed sources, which are offset in phase by 90°, in each instance. The feed sources of the excitation 3 can be obtained in known manner, by means of power splitting and 90° hybrid couplers.

Figure 4:
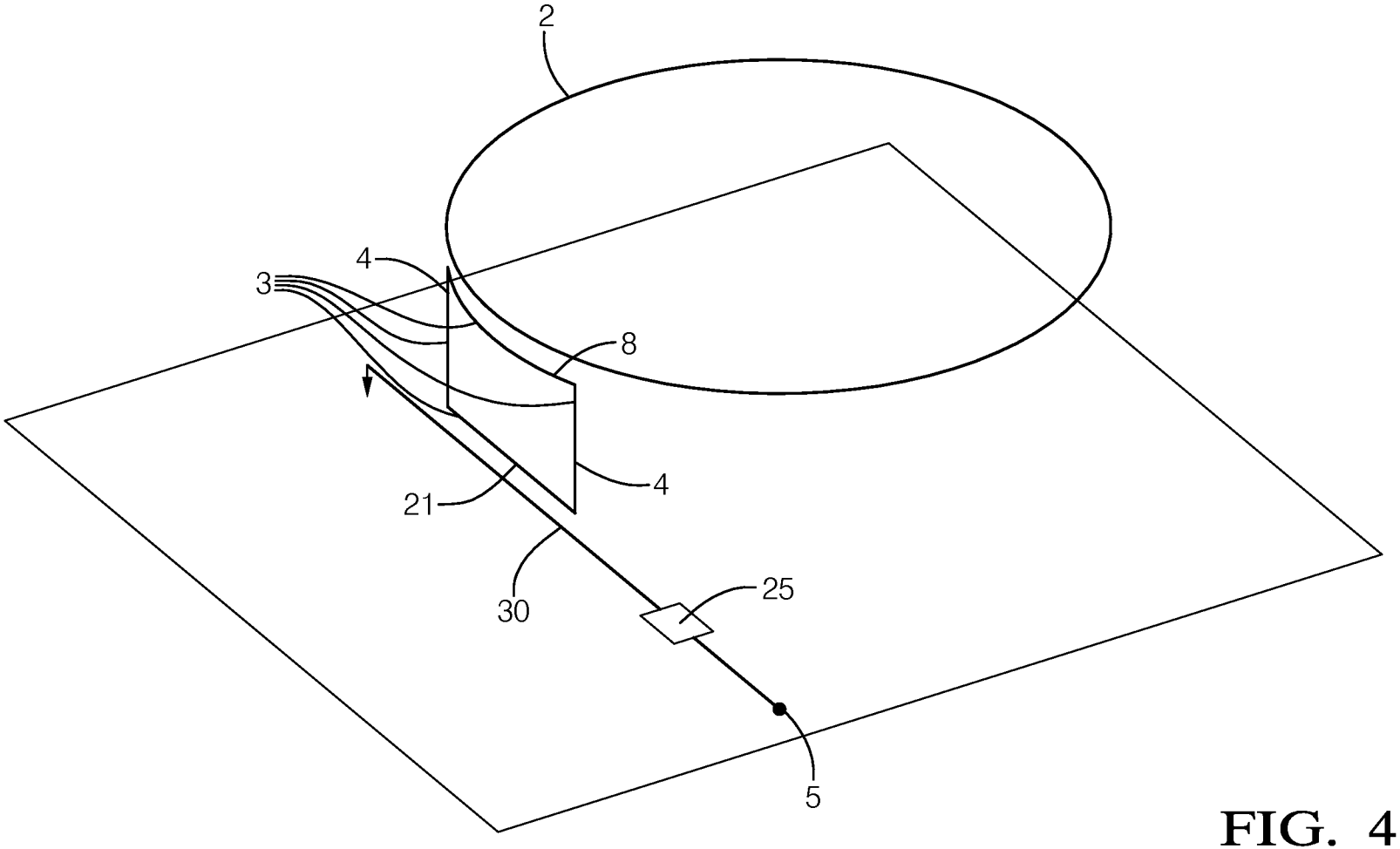
FIG. 4 is a side perspective view of another embodiment of an antenna.

FIG. 4 is a side perspective view of an antenna according to the invention as in FIG. 2, but having a antenna feeder or excitation 3 containing a second directional coupling conductor 21. The second λ/4-directional coupling conductor 8 is guided parallel to a microstrip conductor 30 and forms the second λ/4-directional coupler, together with the λ/4-directional coupling conductor 8 coupled with the ring line radiator 2.

Figure 5:
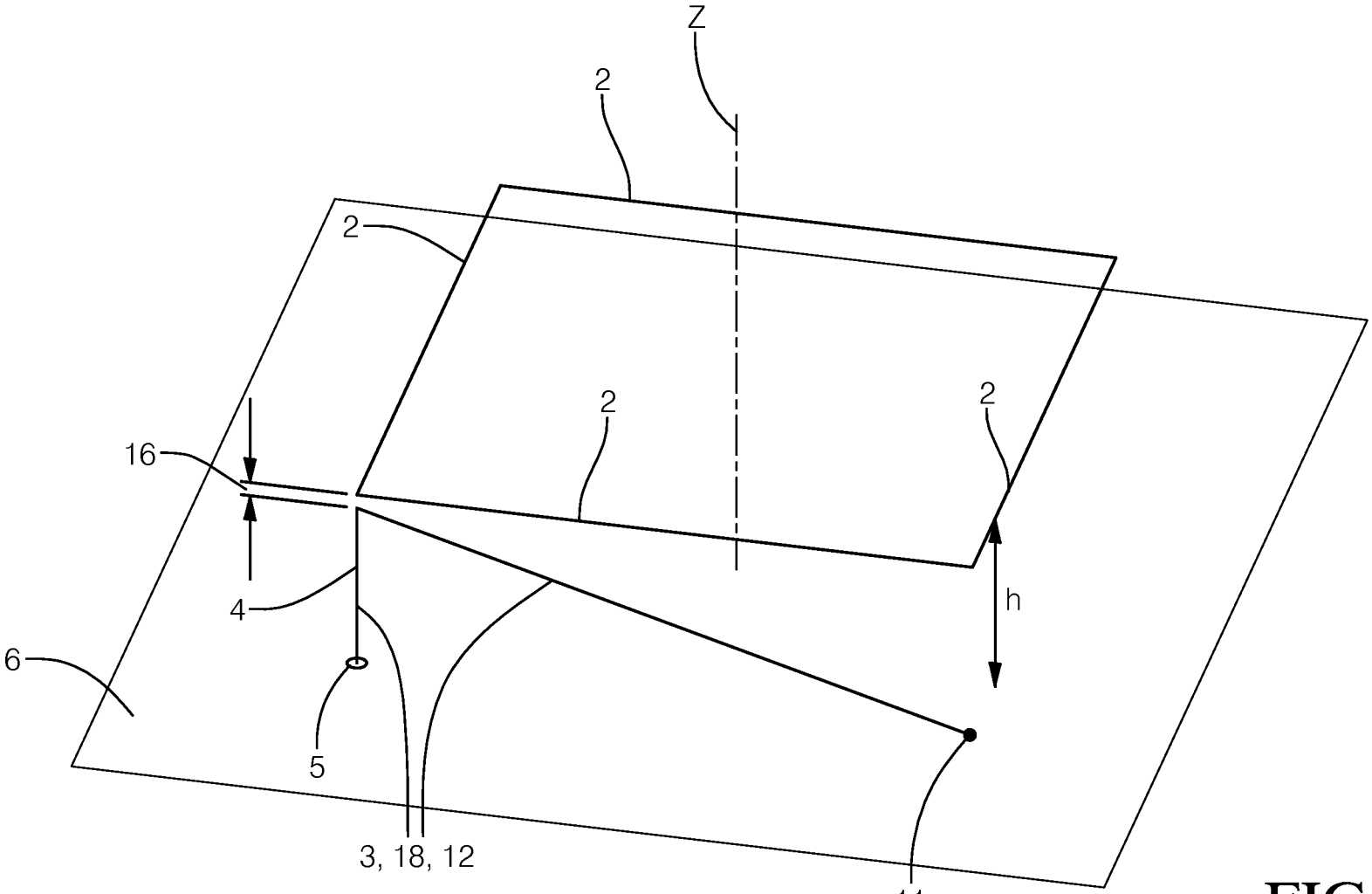
FIG. 5 is a side perspective view of another embodiment of an antenna.

FIG. 5 is a side perspective view of an antenna according to the invention, having a ring line radiator 2 configured as a closed square line ring having an edge length of λ/4. The excitation 3 is structured as a contact-free coupling to the ring line radiator 2, by way of the ramp-shaped λ/4-directionally active coupling structure 18 with the antenna connector 5. The coupling structure 18 contains the vertical radiator 4.

Figure 6:
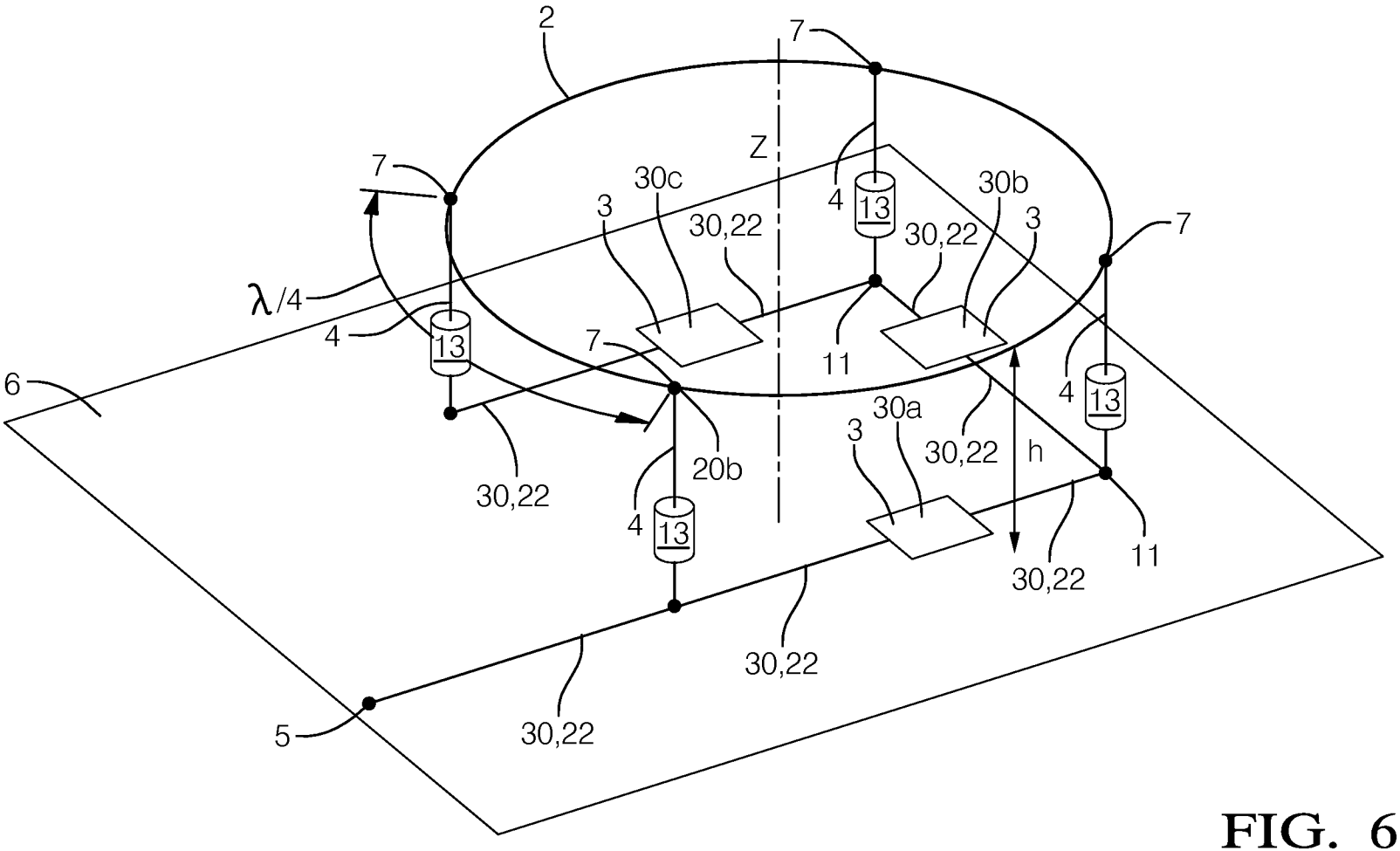
FIG. 6 is a side perspective view of another embodiment of an antenna.

FIG. 6 is a side perspective view of another embodiment of the antenna according to the invention, having λ/4 ring line coupling points 7 spaced apart from one another, whereby the antenna feeder or electromagnetic excitation 3 is produced by way of vertical radiators 4 having a same length, by way of the connection to a power distribution network—consisting of microstrip conductors 30*a*, 30*b*, 30*c* having different wave resistances, and a length of λ/4, which are connected in a chain and formed on the conductive base surface 6.

Figure 7:
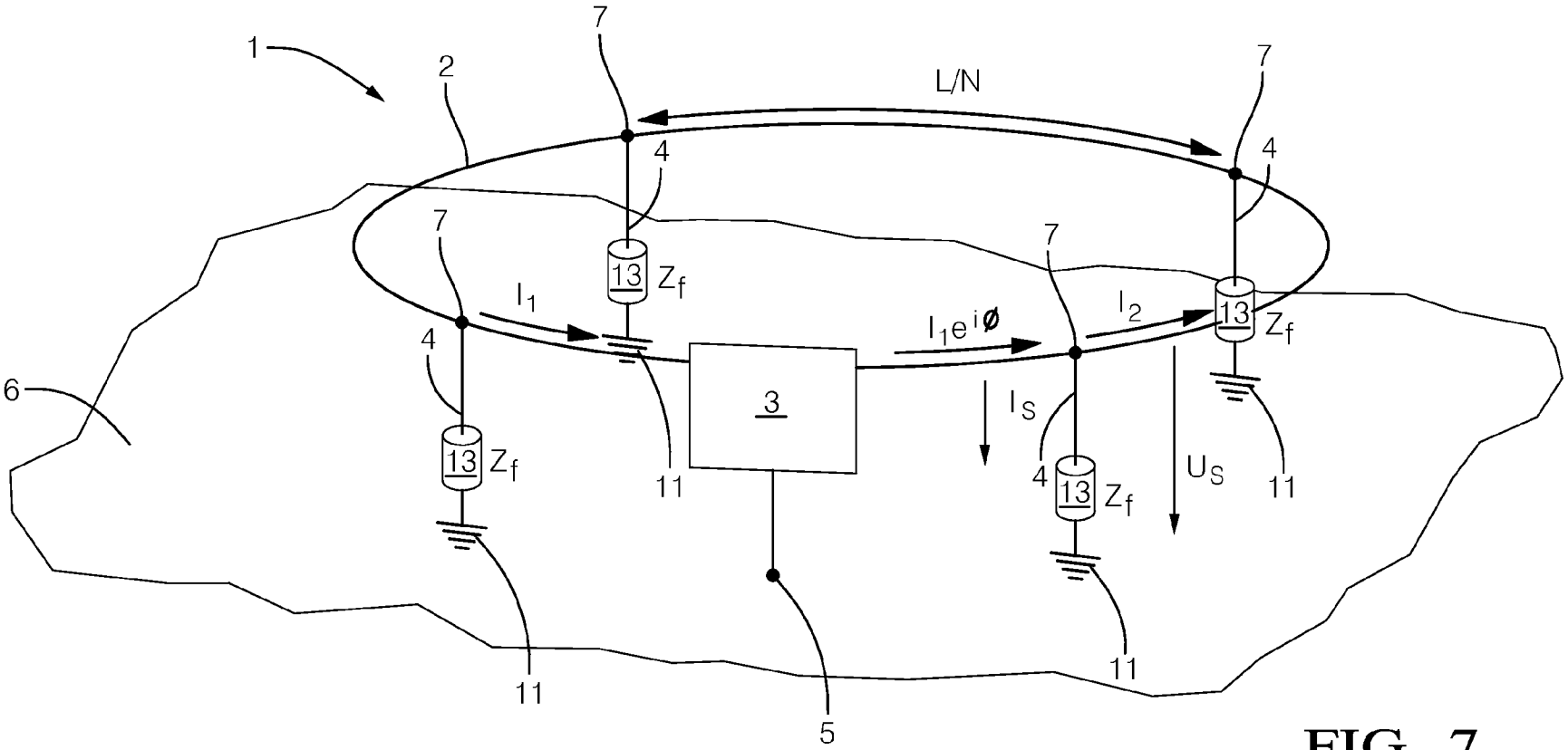
FIG. 7 is a side perspective view of another embodiment of an antenna.

FIG. 7 is a side perspective view of the antenna according to one embodiment of the invention, as an example having circular ring line radiators 2 with an antenna feeder or excitation 3 indicated in general, and having ring line coupling points 7 disposed equidistant on the circumference, with vertical radiators 4 coupled to them. There are low-loss reactance circuits 13 which are inserted at interruption points, with the different reactances X required for production of a continuous current wave on the ring line radiator 2.

Figure 8:
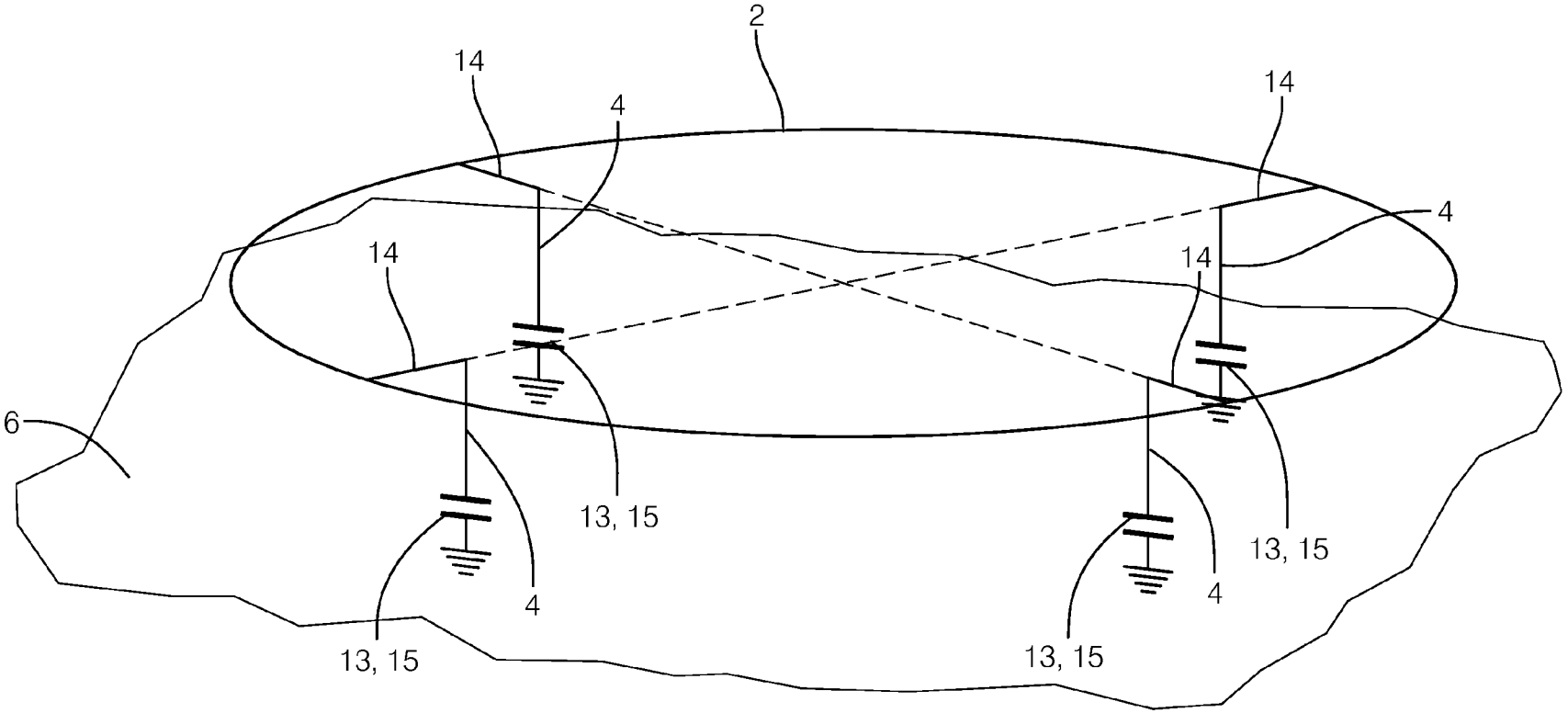
FIG. 8 is a side perspective view of another embodiment of an antenna.

FIG. 8 is a side perspective view of an antenna according to the invention as in FIG. 7, but with horizontal additional elements 14 coupled to vertical radiators for further formation of the directional diagram.

Figure 9:
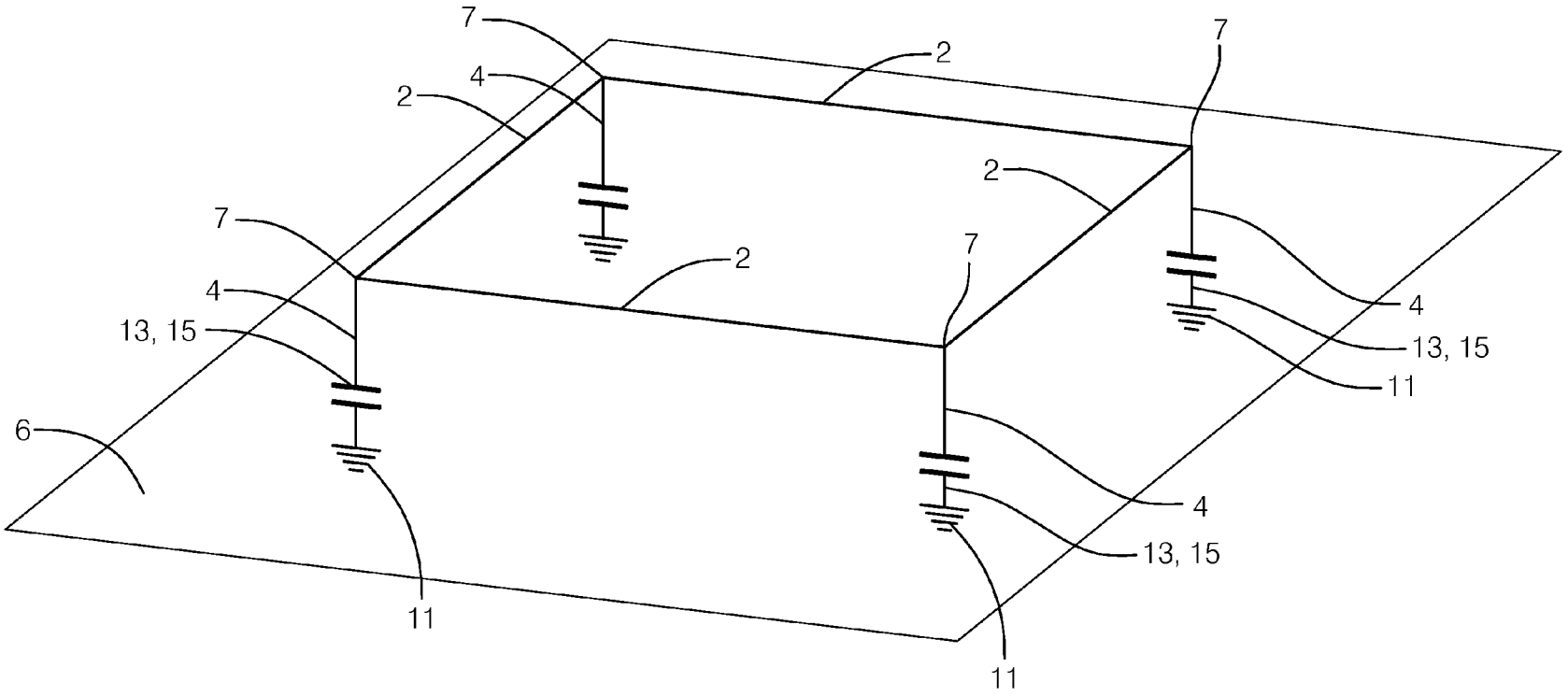
FIG. 9 is a side perspective view of another embodiment of an antenna.

FIG. 9 is a side perspective view of another embodiment of an antenna, comprising a ring line radiator 2 in square form, with four vertical radiators 4 situated at the corners. The antenna feeder or excitation 3, which is configured in different manner, is not shown.

Figure 10:
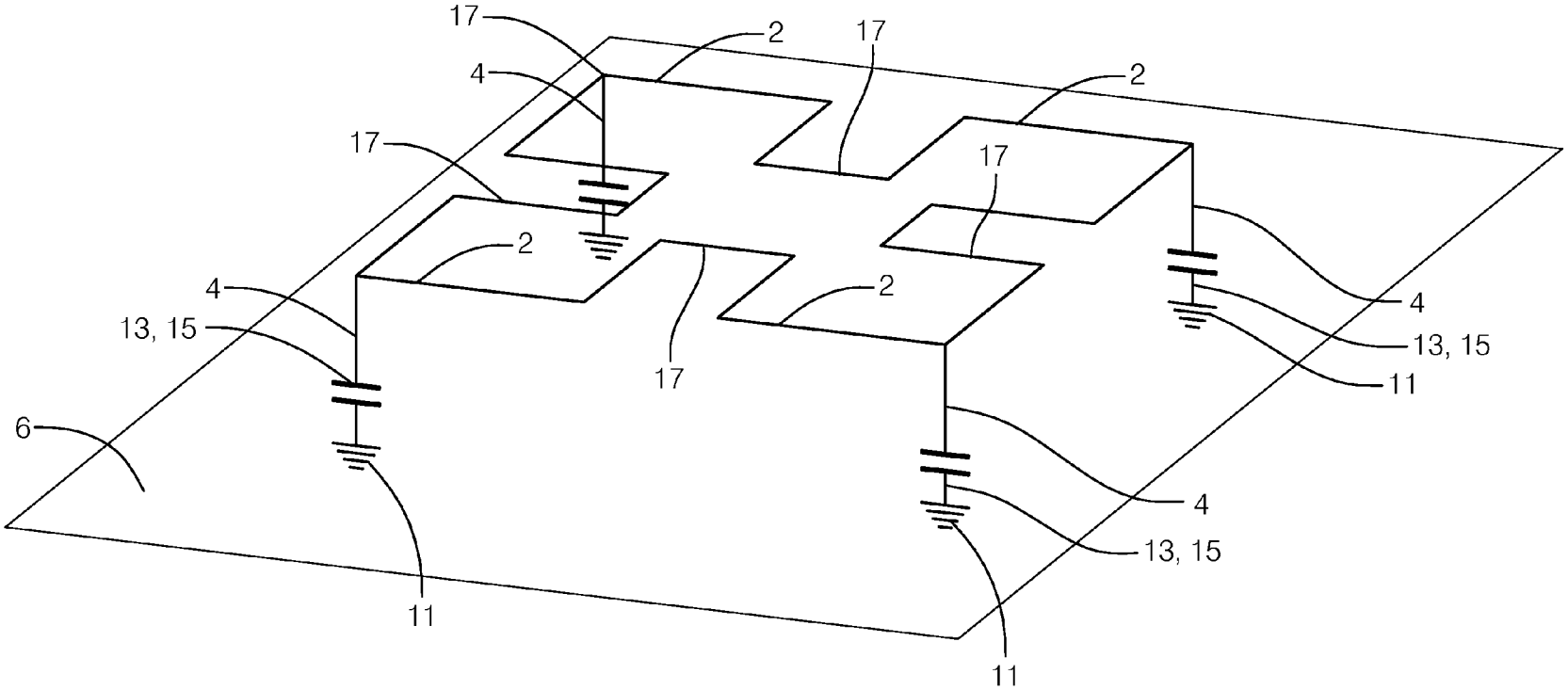
FIG. 10 is a side perspective view of another embodiment of an antenna.

FIG. 10 is a side perspective view of another embodiment of an antenna shown in FIG. 9, whereby, however, each section between adjacent ring line coupling points 7 of the ring line radiator 2 contains a meander-shaped formation 17 that is the same for all sections, to reduce the size of the resonance structure.

Figure 11:
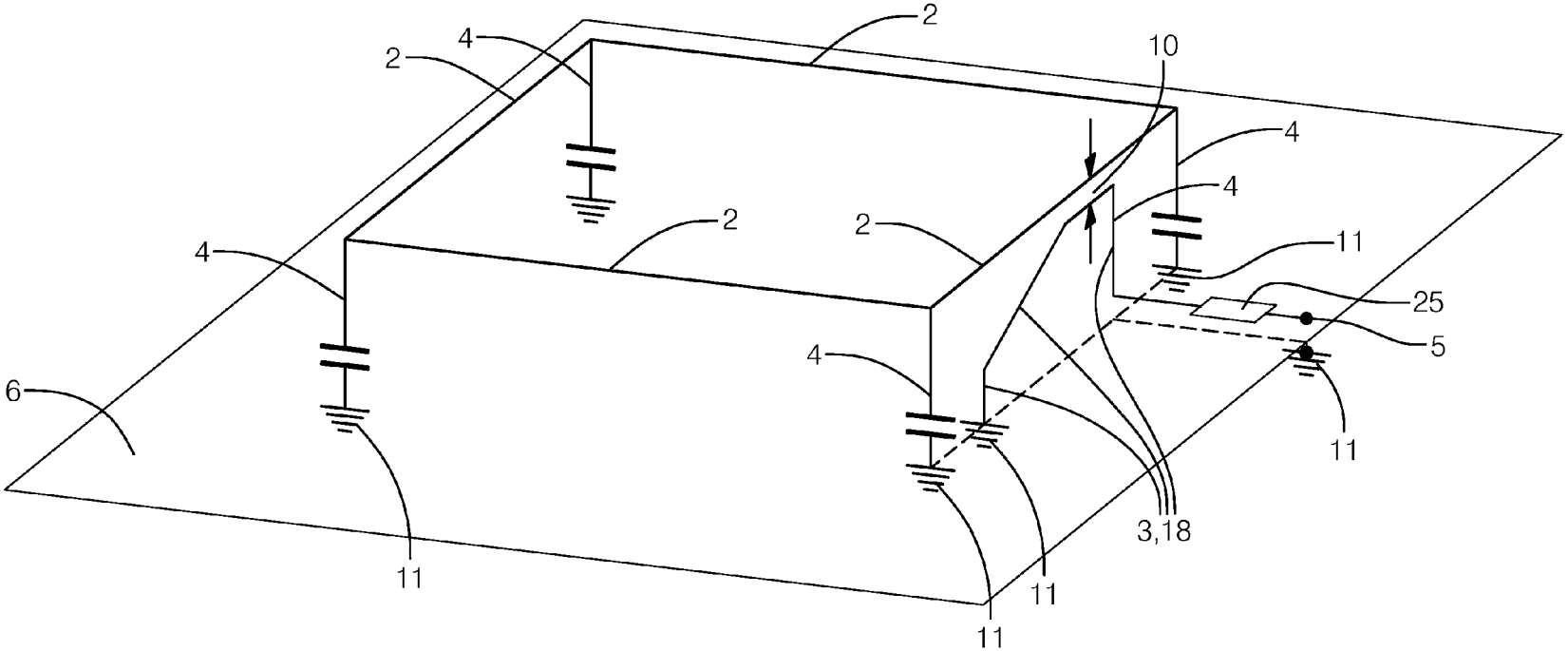
FIG. 11 is a side perspective view of another embodiment of an antenna.

FIG. 11 is a side perspective view of the embodiment of the antenna according to the design shown in FIG. 9, having an electromagnetic excitation 3 in the form of a directed, inductively and capacitively coupled conductor loop as a directional coupler 18, in tapered form, and a network 25 for power adaptation.

Figure 12A:
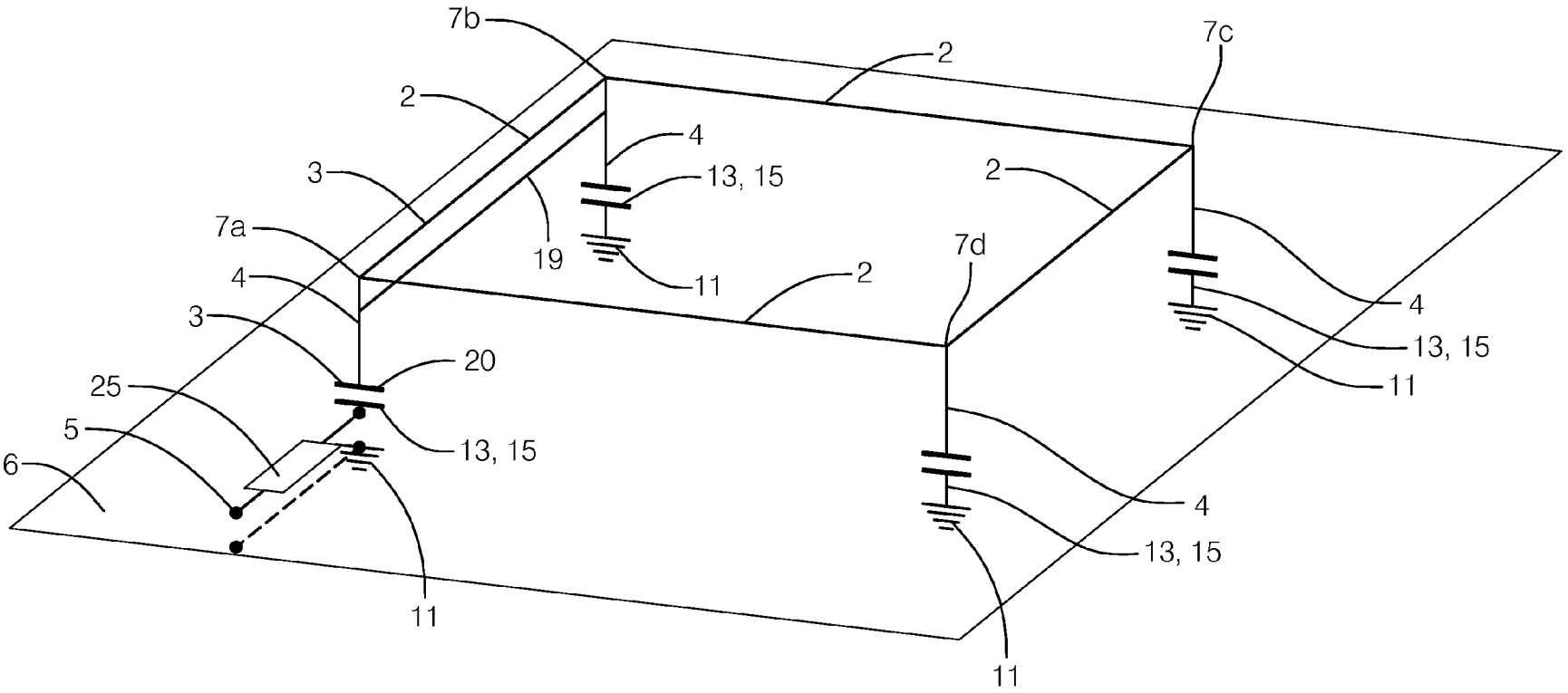
FIG. 12A is a side perspective view of another embodiment of an antenna.

FIG. 12A is a side view of an antenna as shown in FIG. 9, with electromagnetic excitation 3 by means of feed at the lower end, and one of the vertical radiators 4, by way of the reactance circuit 13 configured as a capacitor 15. To support the unidirectionality of the wave propagation on the ring line radiator 2. The antenna is configured by means of configuring the wave resistance of the partial piece of the ring line radiator 2 relative to the adjacent ring line coupling point 7*b*, in deviation from the wave resistance of the other partial pieces of the ring line radiator 2.

Figure 12B:
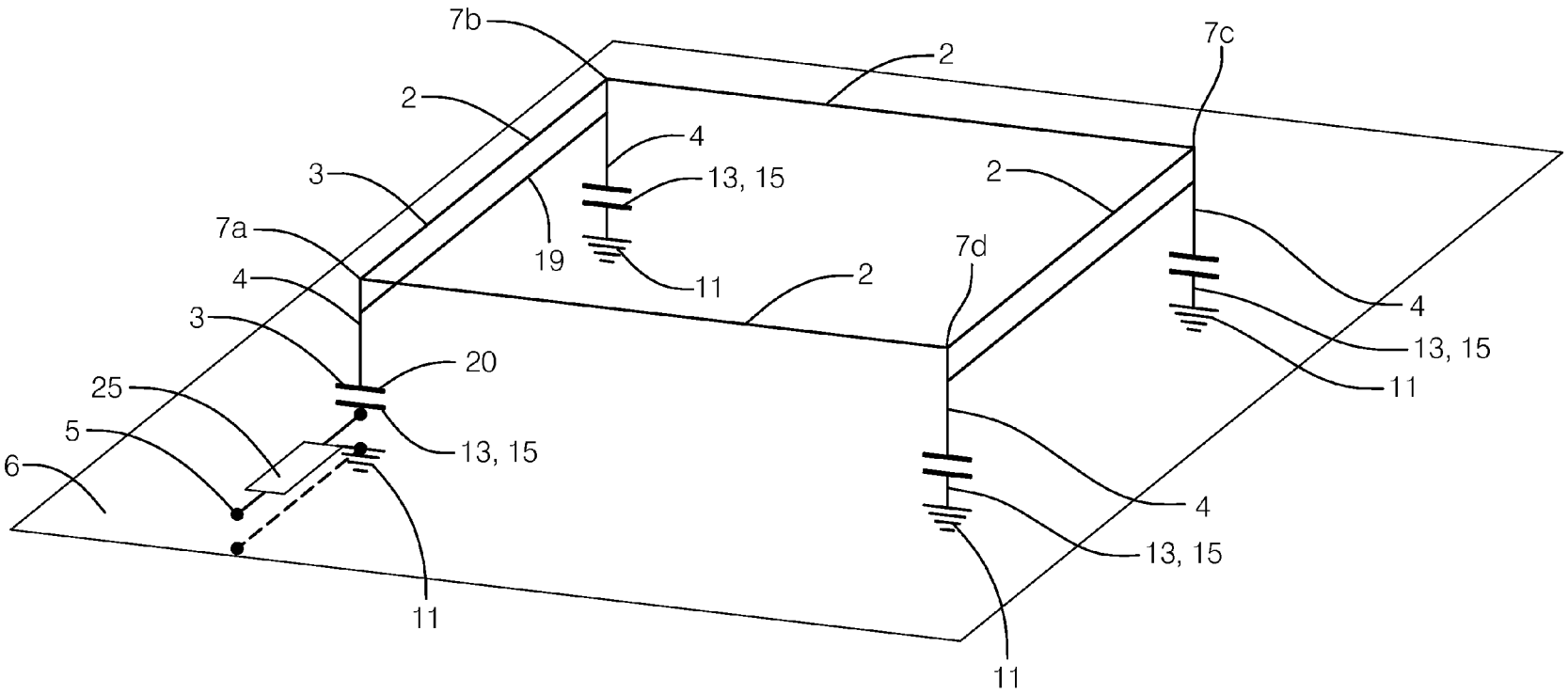
FIG. 12B is a side perspective view of another embodiment of an antenna.

FIG. 12B is a side view of the embodiment as shown in FIG. 12A but with two partial pieces of the ring line radiator 2 that lie opposite one another, whose wave resistance deviate from that of the other partial pieces.

Figure 13:
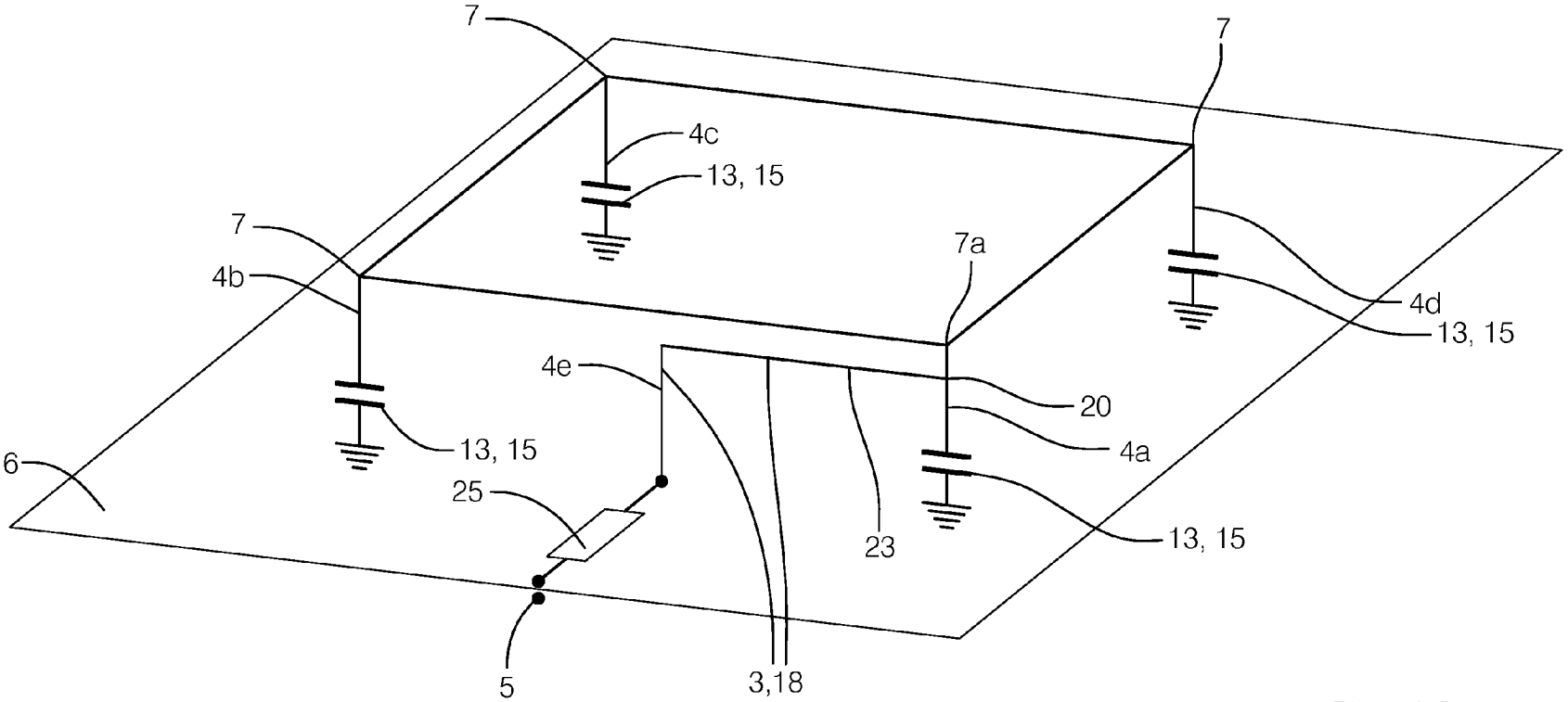
FIG. 13 is a side perspective view of another embodiment of an antenna.

FIG. 13 is a side perspective view of the antenna according to the invention as in FIG. 9. The unidirectional effect of the antenna feeder or electromagnetic excitation 3 is produced by means of partial coupling of a coupling conductor 23 that is guided over a part of the ring line radiator 2, parallel to it, to one of the vertical radiators 4. The other end of the coupling conductor 23 is connected with the antenna connector 5 by way of a vertical radiator 4, with an adaptation network 25 connected to it.

Figure 14:
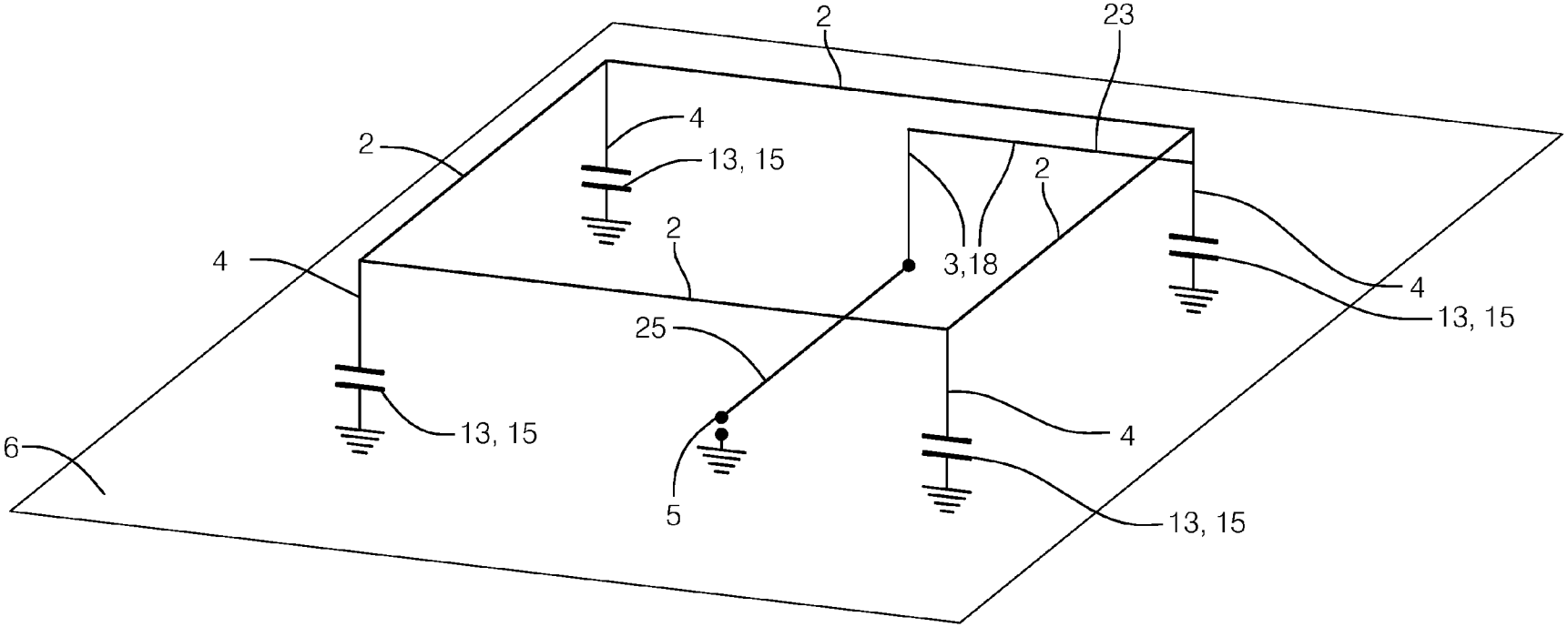
FIG. 14 is a side perspective view of another embodiment of an antenna.

FIG. 14 is a side perspective view of another embodiment of an antenna as shown in FIG. 13, whereby the adaptation network 25 is structured in the form of a high-ohm transmission line laid parallel to the electrically conductive base surface 6, over about ¼ of the wavelength.

Figure 15:
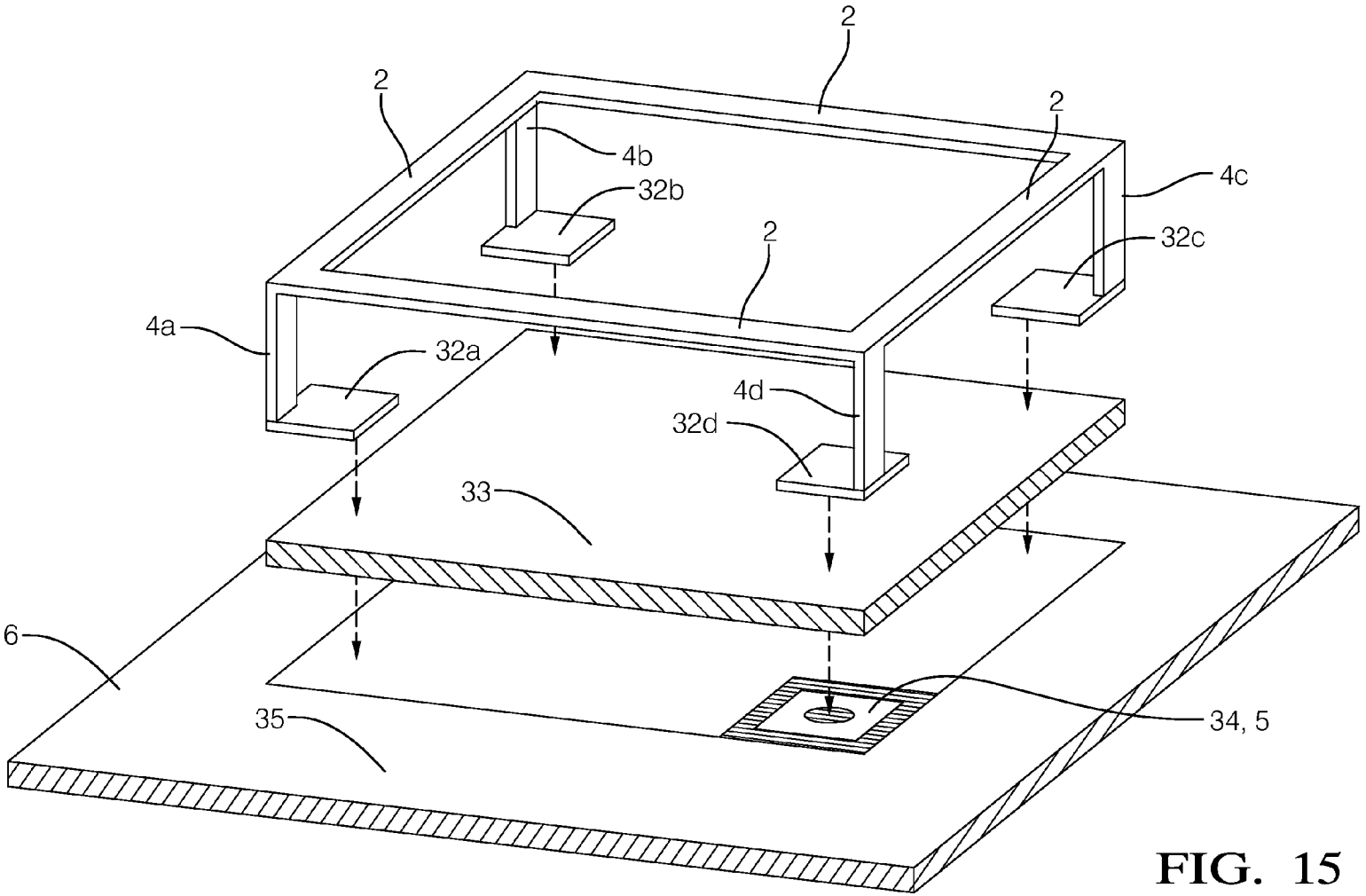
FIG. 15 is a side perspective view of another embodiment of an antenna.

FIG. 15 is a side perspective view of another embodiment of the antenna as shown in FIGS. 12A and 12B. The capacitors 15 are formed so that the vertical radiators 4 are shaped, at their lower end, to form individually configured planar capacitor electrodes 32*a*, 32*b*, 32*c*, 32*d*. By means of interposition dielectric panel 33 situated between these and the electrically conductive base surface 6 structured as an electrically conductive coated circuit board, the capacitors 15 are configured for coupling of three vertical radiators 4*a*, 4*b*, 4*c* to the electrically conductive base surface 6. For capacitive coupling of the fourth vertical radiator 4*d* to the antenna connector 5, this radiator is structured as a planar counter-electrode 34 insulated from the conductive layer.

Figure 16:
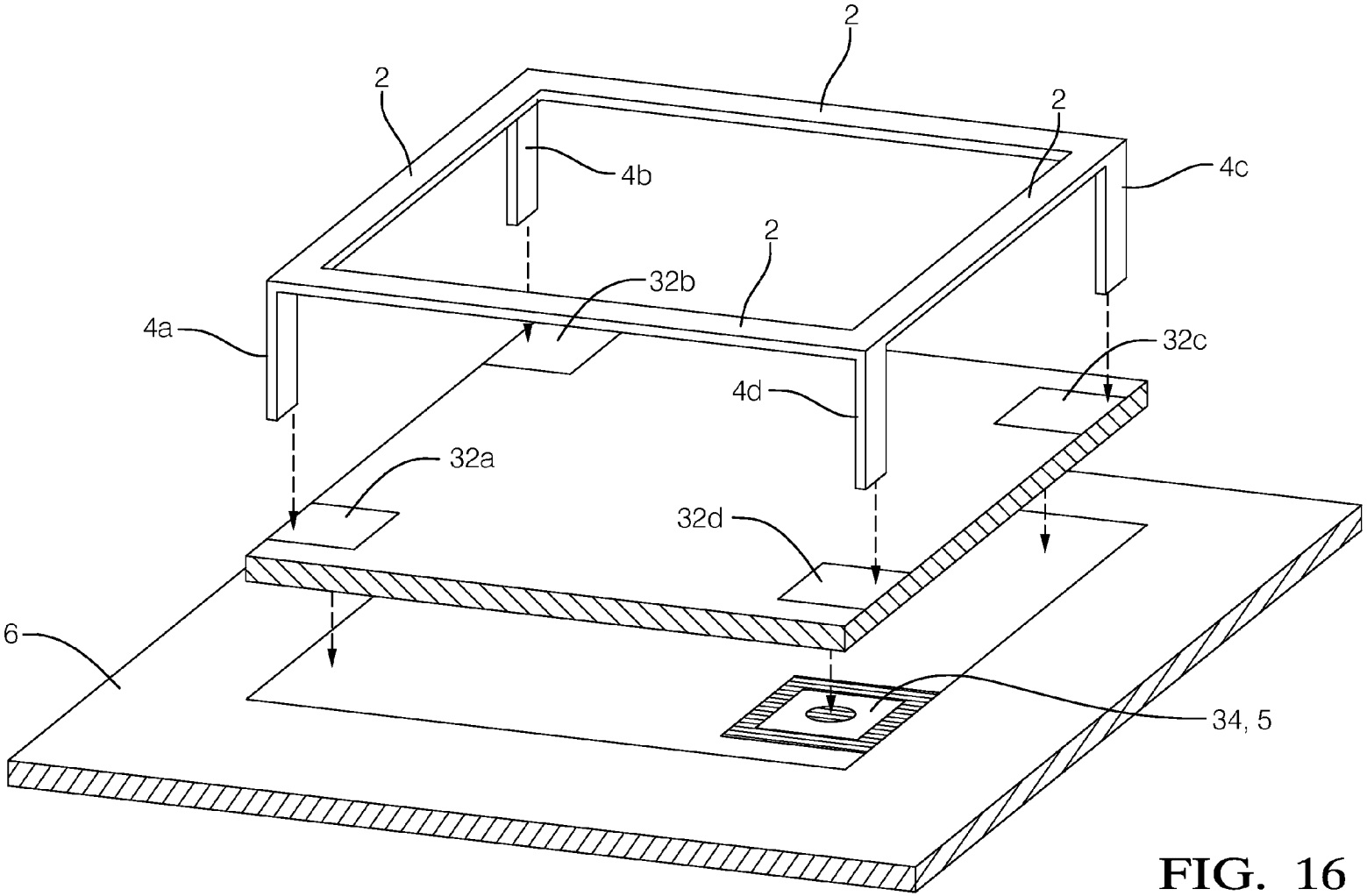
FIG. 16 is a side perspective view of another embodiment of an antenna.

FIG. 16 is a side perspective view of another embodiment of an antenna as in FIGS. 12A and 12B. Between the lower ends of the vertical radiators 4*a*, 4*b*, 4*c*, 4*d* and the electrically conductive base surface 6 structured as a conductively coated circuit board, another conductively coated dielectric circuit board is inserted. The lower ends of the vertical radiators 4*a*, 4*b*, 4*c*, 4*d* are galvanically connected with the planar capacitor electrodes 32*a*, 32*b*, 32*c*, 32*d* that are imprinted on the top of the dielectric circuit board, to form the capacitors 15 for capacitive coupling of three of the vertical radiators 4 to the electrically conductive base surface 6. For capacitive coupling of the fourth vertical radiator 4*d* to the antenna connector 5, the latter is structured as a planar counter-electrode 34 insulated from the conductive layer.

Figure 17:
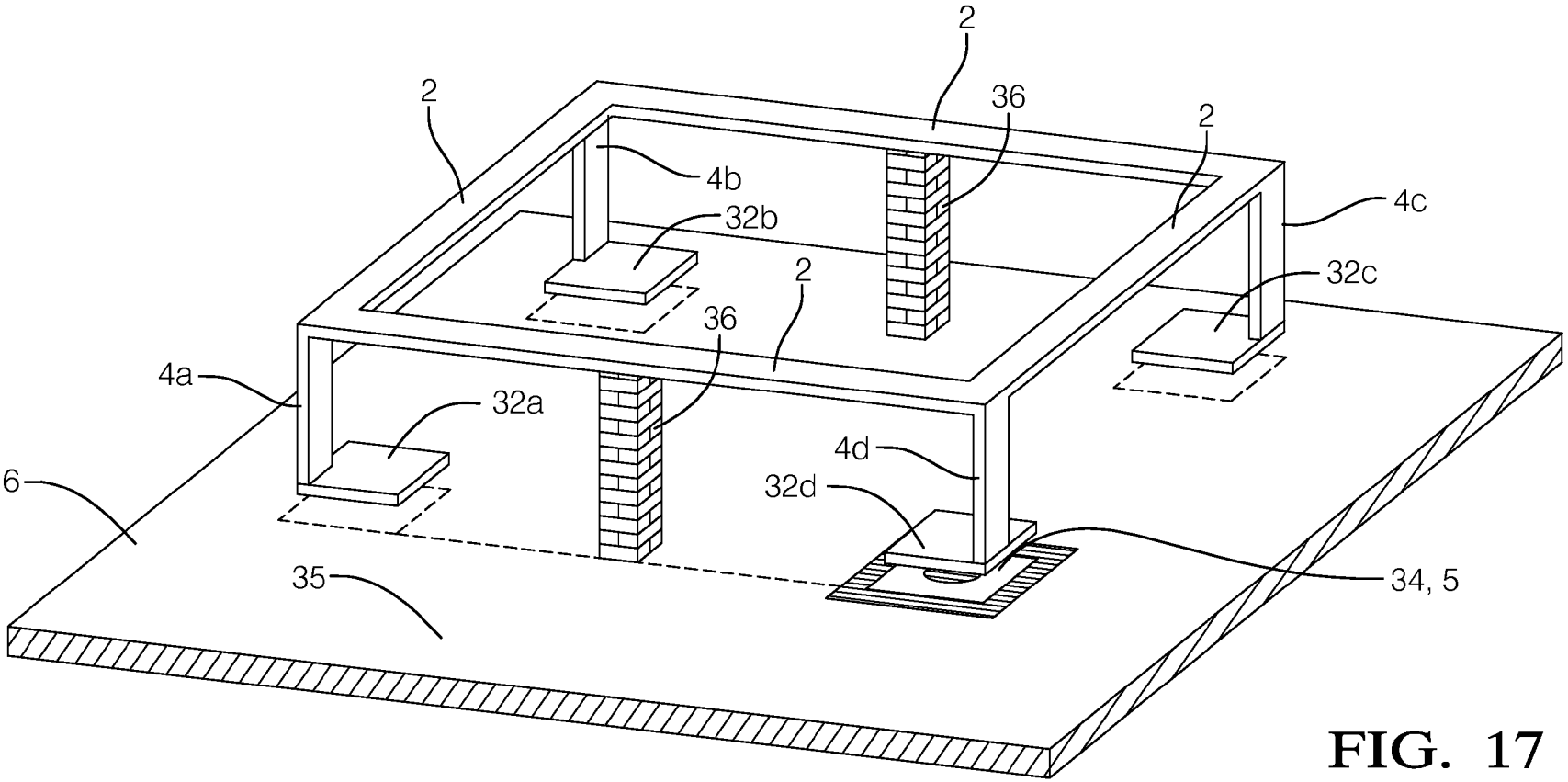
FIG. 17 is a side perspective view of another embodiment of an antenna.

FIG. 17 is a side perspective view of an antenna according to the invention as in FIGS. 15 and 16, whereby the conductive structure, consisting of the ring conductor 2 and the vertical radiators 4 connected with it, is fixed in place by means of a dielectric support structure 36, so that the dielectric panel 33 is implemented in the form of an air gap.

Figure 18A:
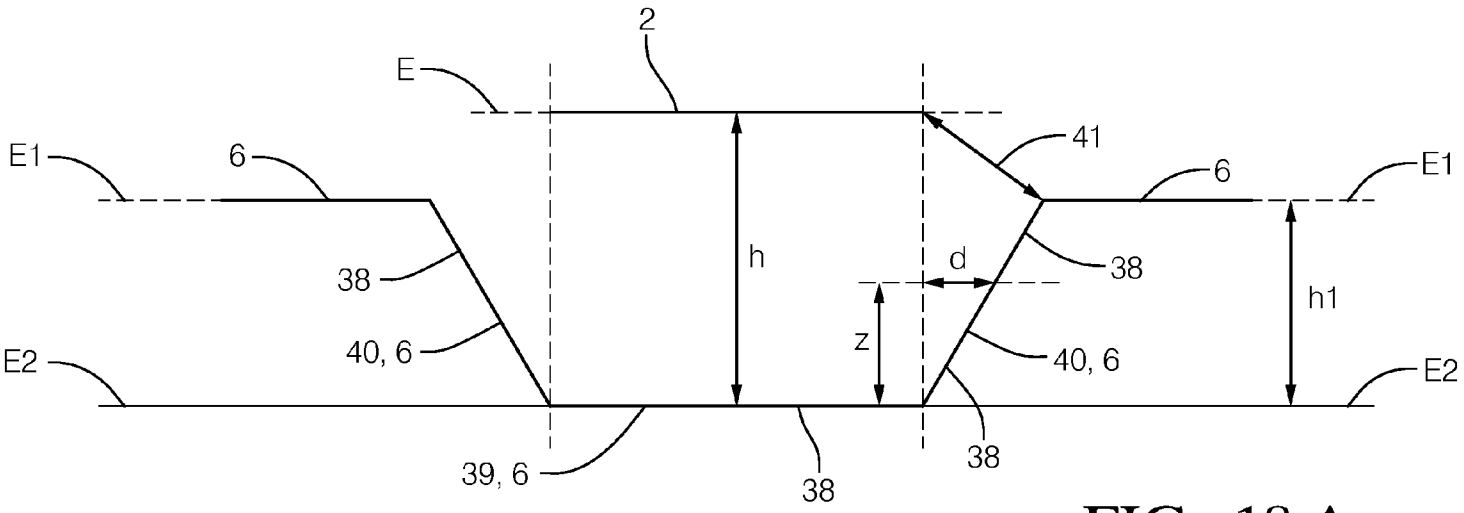
FIG. 18A is a profile view of a ring line radiator in a cavity.
Figure 18B:
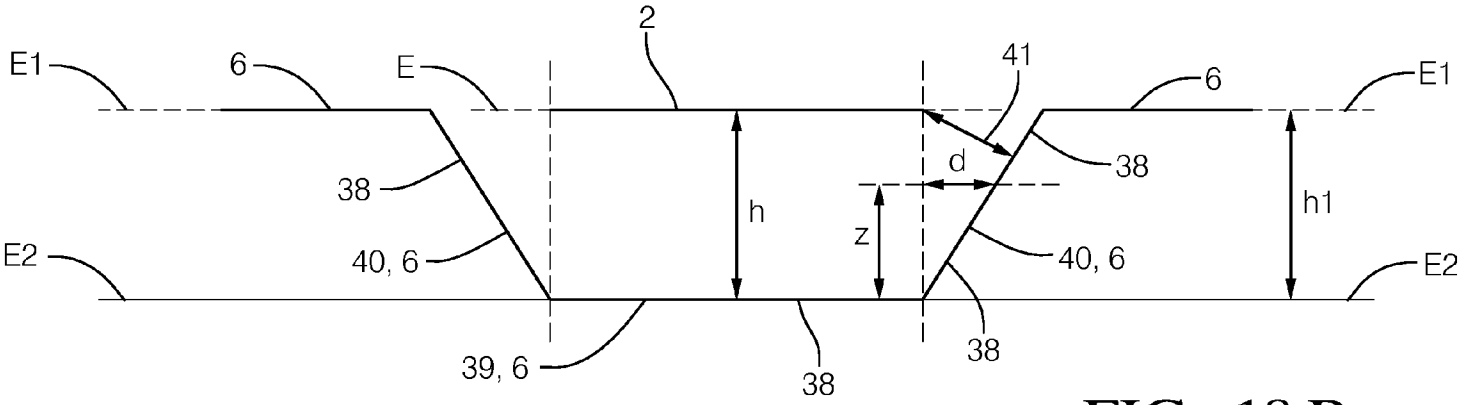
FIG. 18B is a profile view of another embodiment of a ring line radiator in a cavity.

FIGS. 18A and 18B are alternative embodiments, each showing a profile view of a ring line radiator 2 in a cavity 38 that opens toward the top, which is formed, for example, for the purpose of integration into a vehicle body, by means of shaping the conductive base plane 6. The height h1 designates the depth of the cavity, and the height h designates the distance of the ring line radiator 2 above the cavity base surface 39. An overly small distance 41 between the ring line radiator 2 and the cavity side surfaces 40 has the effect of constricting the frequency bandwidth of the antenna 1.

a) h>h1: partial integration b) h=h1: complete integration

Figure 19:
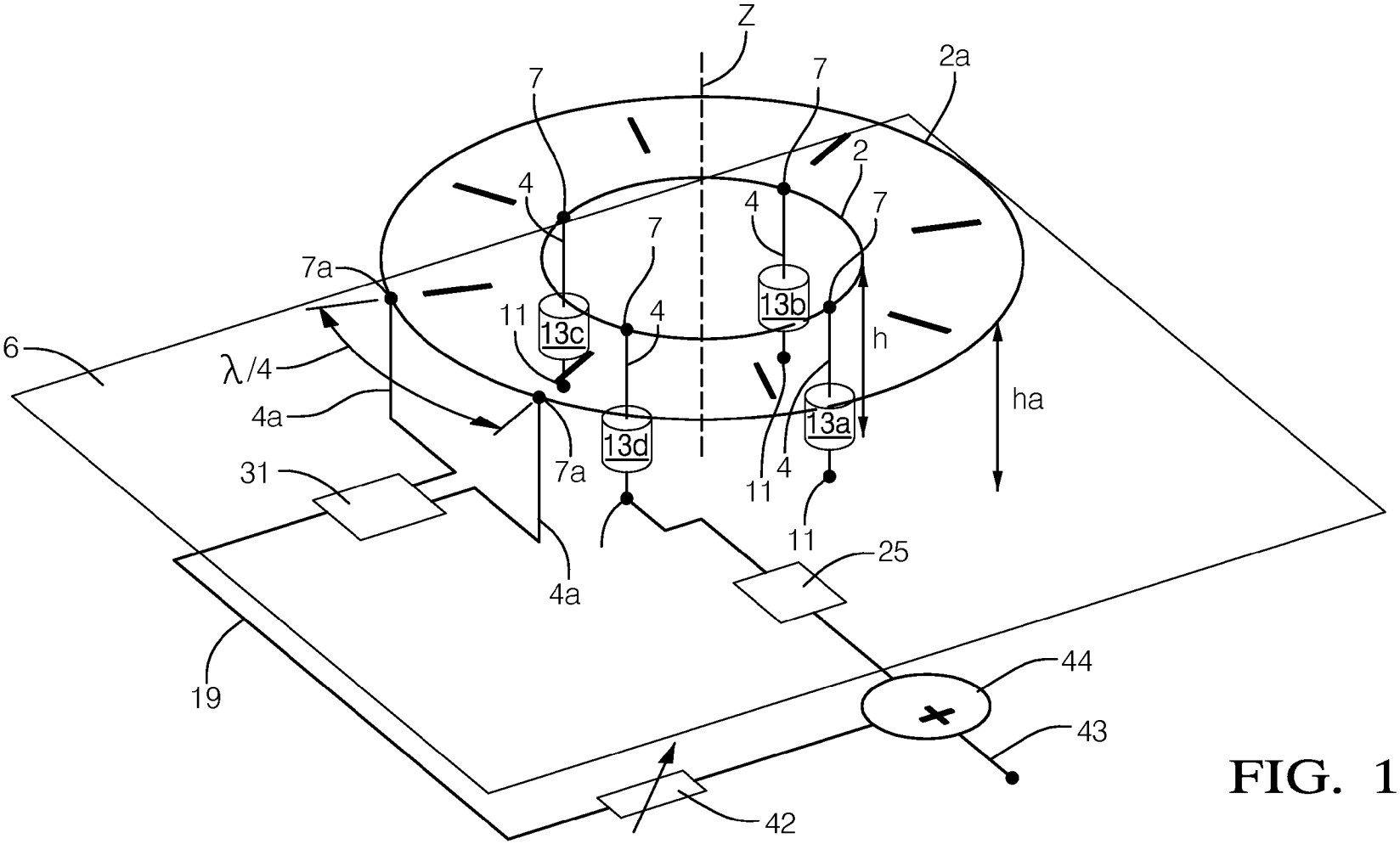
FIG. 19 is a side perspective view of a ring line radiator, combined with another ring line radiator.

FIG. 19 is a side perspective view of a ring line radiator 2 according to the invention, combined with another ring line radiator 2*a*, having the same center Z and having a phase difference of the line wave that spreads on the ring line 2*a*, in a single direction of rotation, over a rotation of approximately, substantially, or precisely N*2π, with (N>2), for forming a directional antenna having a directional diagram with an azimuthal main direction at the directional antenna connector 43.

Figure 20:
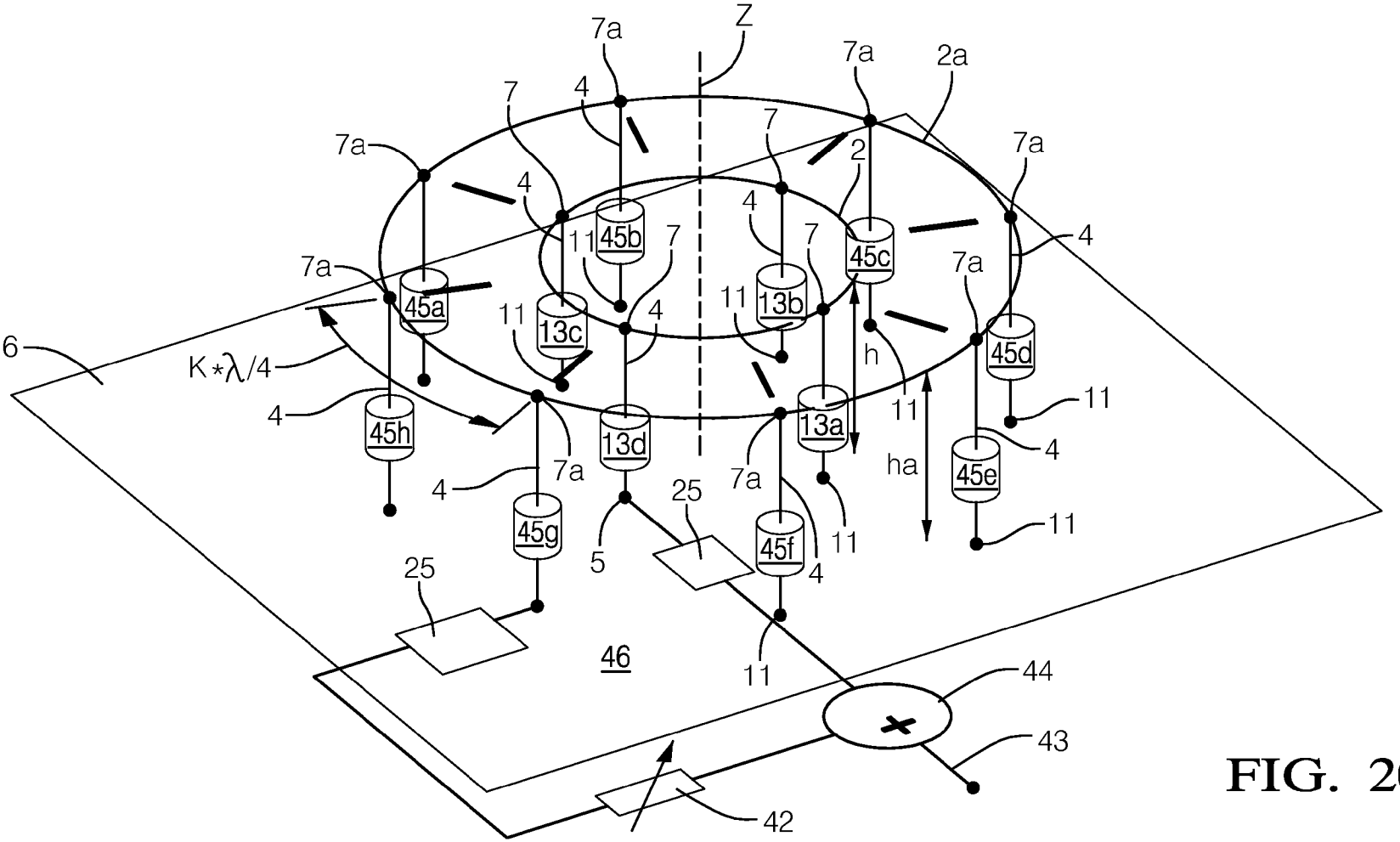
FIG. 20 is a side perspective view of a directional antenna as in FIG. 19, having a circular ring line radiator.

FIG. 20 is a side perspective view of a directional antenna as in FIG. 19, having a circular ring line radiator 2 and another ring line radiator 2*a* with N=2. The vertical radiators 13*a-d* and 45*a-h* are disposed equidistant on the two ring line radiators and in accordance with a phase difference of the running wave of π/2, in each instance. The reception signals at the antenna connector 5 and at the radiator connection point 46 are superimposed by way of a controllable phase rotation element 42 in the summation and selection network 44, to form the directional diagram having a controllable azimuthal main direction.

Figure 21:
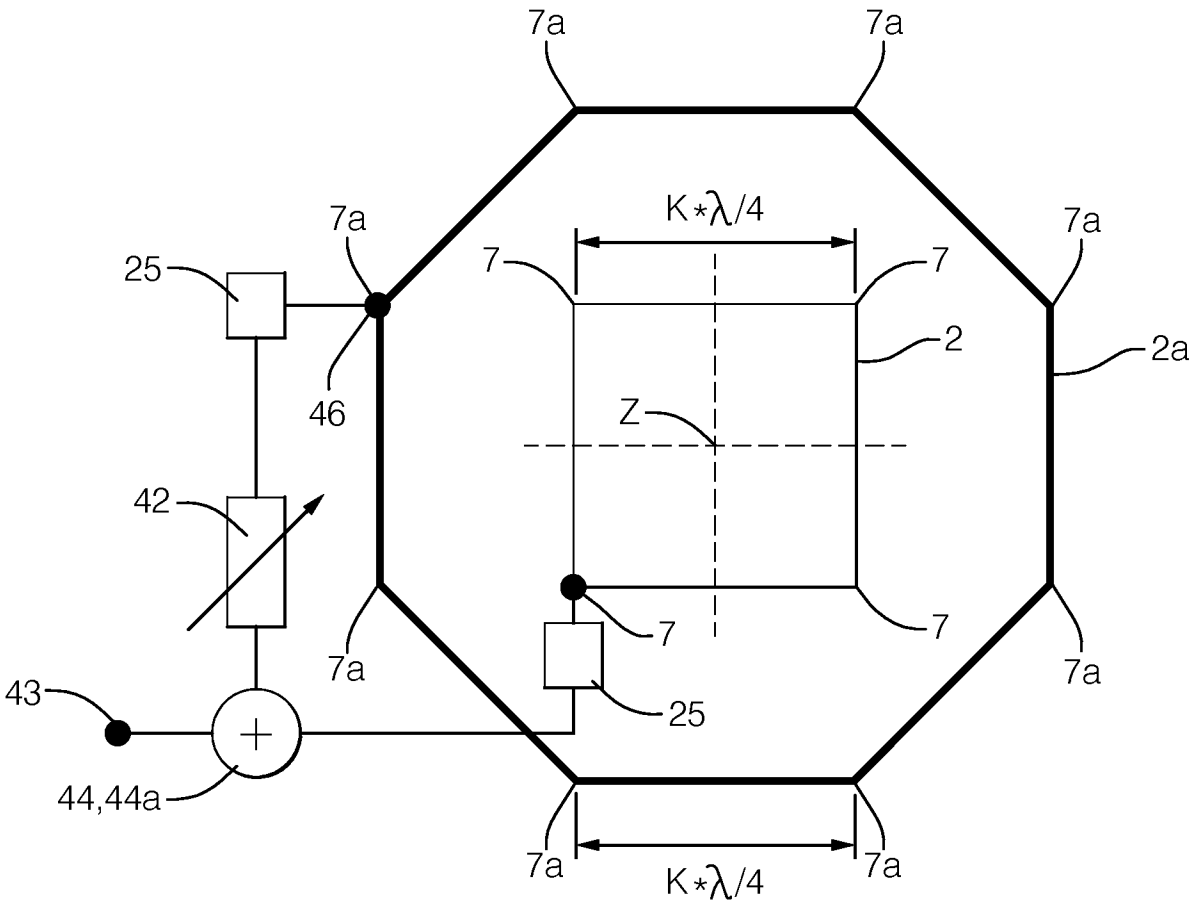
FIG. 21 is a top plan view of a directional antenna as in FIG. 20, but with a square-shaped ring line radiator.

FIG. 21 is a top plan view of a directional antenna as in FIG. 20, but with a square-shaped ring line radiator 2 (phase difference of the running wave of 2π distributed over the circumference), and with an octagon-shaped additional ring line radiator 2*a* (phase difference of the running wave of 4π distributed over the circumference).

Figure 22:
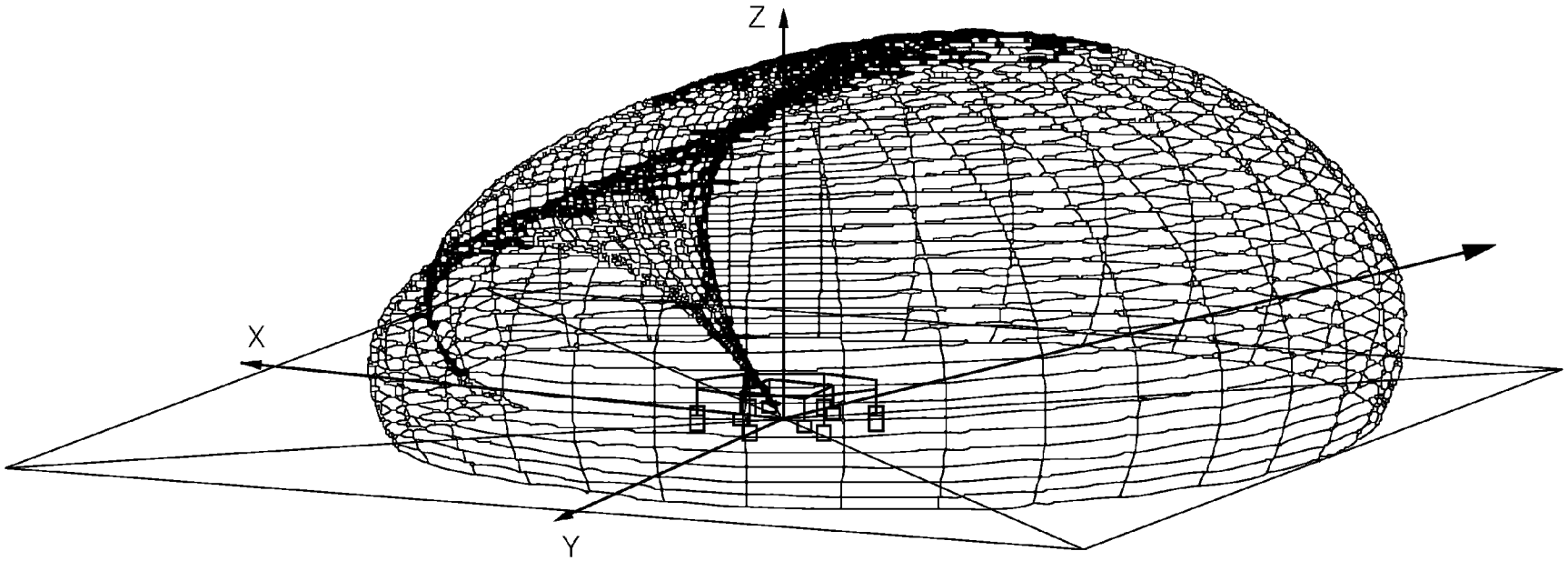
FIG. 22 is a side view of a spatial directional diagram of the directional antenna in FIG. 21.

FIG. 22 is a side view of a spatial directional diagram of the directional antenna in FIG. 21 with marked azimuthal main direction (arrow) and zero point.

According to one embodiment of the invention, such as shown for example in FIG. 1A but also shown for example in the other Figures, the antenna for reception of circularly polarized satellite radio signals comprises at least one conductor loop 2 disposed oriented essentially or substantially horizontally above a conductive base surface 6, having an array for electromagnetic excitation 3 of the conductor loop, connected with an antenna connector 5. The conductor loop is configured as a ring line radiator 2, by means of a polygonal or circular closed ring line, in a horizontal plane having the height h, running above the conductive base surface 6. The ring line radiator 2 forms a resonance structure and is electrically excited by means of the electromagnetic excitation 3, in such a manner that the current distribution of a running line wave in a rotation direction occurs on the ring line, the phase difference of which, over one revolution, amounts to approximately, substantially or even approximately, substantially or precisely $2\pi$. In order to support the vertically oriented components of the electromagnetic field, at least one vertical radiator 4 that runs toward the conductive base surface is present on the ring line radiator 2, which radiator(s) is/are electromagnetically coupled both with the ring line radiator 2 and with the electrically conductive base surface 6. In order to produce a pure line wave, the height h should preferably be selected to be smaller than ⅕ of the free-space wavelength $\lambda$.

The production tolerances required for antennas according to one embodiment of the invention can be adhered to significantly more easily, in advantageous manner. Another very significant advantage of one embodiment of the invention results from the property that in addition to the horizontally polarized ring line radiator 2, another radiator 4 is present at least at one ring line coupling point 7, which radiator has a polarization oriented perpendicular to the polarization of the ring line radiator 2. This radiator can advantageously be used also for reception of terrestrially transmitted signals that are vertically polarized, if such signals are present.

As shown in FIG. 1A, the ring line radiator 2 of is configured as a passive resonance structure for a transmission or reception antenna, which allows emission or reception of essentially or substantially circularly polarized waves in an elevation angle range between theta=0° (vertical) and theta=65° and essentially or substantially vertically polarized waves in an elevation angle range between theta=90° and theta=85°, whereby theta describes the angle of the incoming wave relative to the vertical. Azimuthally, in this connection, all-round emission is generally aimed at.

The distribution of the currents on an antenna in reception operation is dependent on the terminal resistance at the antenna connector point. In contrast to this, in transmission operation, the distribution of the currents on the antenna conductors, with reference to the feed current at the antenna connector point, is independent of the source resistance of the feed signal source, and is therefore clearly linked with the directional diagram and the polarization of the antenna. Because of this non-ambiguity in connection with the law of reciprocity, according to which the emission properties—such as directional diagram and polarization—are identical in transmission operation and reception operation, the task according to the invention is accomplished, with regard to polarization and emission diagrams, using the configuration of the antenna structure for producing corresponding currents in transmission operation of the antenna. In this way, the task according to the invention is also accomplished for reception operation. All the deliberations conducted hereinafter, concerning currents on the antenna structure and their phases, or their phase reference point, thus relate to reciprocal operation of the reception antenna as a transmission antenna, unless reception operation is explicitly addressed.

For example, FIG. 1A shows an antenna according to one embodiment of the invention, having a circular ring line radiator 2 configured as a resonance structure, for producing a circularly polarized field. To produce the resonance, the extended length of the ring line of the ring line radiator 2 is selected so that it essentially or substantially corresponds to the line wavelength $\lambda$. Ring line radiator 2 is configured to run in a substantially horizontal plane having the height h above the conductive base surface 6, so that it forms an electrical line with reference to the conductive base surface 6, with a wave resistance that results from the height h and the effective diameter of the essentially wire-shaped ring line conductor. A line wave that spreads exclusively in one direction on the ring line radiator 2 should be excited to produce the desired circular polarization, with an azimuthally dependent phase of a direction of rotation of the radiation in the remote field. This is done by means of an antenna feeder forming an electromagnetic excitation 3, which brings about the continuous wave having a wavelength over the circumference of the line, in exclusively one direction of rotation. For this purpose, feed of signals that differ in phase by 90° takes place at $\lambda/4$ ring line coupling points 7 that are spaced apart from one another.

Vertical radiators flare, or can be configured in at least one embodiment to support vertical components of the electrical radiation field. These vertical radiators 4 allow the emission of vertical electrical field components, and wherein there is produced the excitation 3 of the ring line radiator 2. The production of the signals that differ in phase by 90°, for feeding at the foot points of the vertical radiators 4, can occur, for example, by means of a power splitter and phase shifter network 31, and by way of a corresponding adaptation network 25, formed along this antenna feeder.

FIG. 1B, shows a similar antenna according to one embodiment of the invention is shown, but in this design there are additional vertical radiators 4, which do not belong to the antenna feeder or excitation 3, which are coupled with the ring line radiator 2 at ring line coupling points 7, and are passed to the electrically conductive base surface 6. There are also which low-loss reactance circuits 13 of the reactance X inserted at interruption points.

By means of the configuration of the vertical radiators 4 as well as the inserted reactance X, propagation of the line wave on the ring line radiator 2 can be brought about at a preferably uniform distribution of the distances of $\lambda/4$ between the ring line coupling points 7.

FIG. 2A shows another advantageous embodiment of the invention, production of the continuous line wave on the ring line radiator 2 takes place via antenna feeder 3. Antenna feeder 3 is formed with an excitation 3 that is produced by means of a parallel directional coupling conductor 8. The conductor 8 is guided at a coupling distance that is advantageous with regard to the line wave resistance, over an extended length of $\lambda/4$ parallel to the ring line radiator 2. Directional coupling conductor 8 is connected on one side to the antenna connector 5, by way of a vertical radiator 4*a* and to an adaptation network 25. Directional coupling conductor 8 is coupled on the other side with the conductive base surface 6, by way of a vertical radiator 4*b*.

FIG. 2B shows another embodiment of the invention, which shows the antenna feeder or excitation 3 for producing a continuous line wave on the ring line radiator 2. Antenna feeder or excitation 3 is provided by means of two essentially or substantially vertical radiators 4, which run parallel at a small distance 37, with reference to the ¼-line wavelength, and are guided to the ring line radiator 2 by way of galvanic coupling points 7. One vertical radiator 4*a* is connected with antenna connector 5 by way of an adaptation network 25, and another vertical radiator 4*b* is connected with conductive base surface 6 by way of a ground connection point 11.

Similarly, as in FIG. 2A, antenna feeder or electromagnetic excitation 3 in FIG. 4 uses a first λ/4-directional coupler, which provided by means of a parallel directional coupling conductor 8 described above. For representation of the power splitter and phase shifter network 31, a second directional coupling conductor 21 for producing two signals that differ by 90° is coupled to a transmission conductor 30 that runs on the conductive base surface 6, by means of parallel guidance at a slight distance. Second directional coupling conductor 21 is connected with first directional coupling conductor 8, for feeding by way of vertical radiators 4, and wherein the microstrip conductor 30 is connected with the antenna connector 5.

FIG. 3 shows another embodiment wherein there are 2 N=4 ring line coupling points 7 for producing a continuous line wave on the ring line radiator, spaced apart from one another by λ/4, in each instance, along the closed ring line structure. Vertical radiators 4 are galvanically coupled. The electromagnetic excitation 3 or antenna feeder is configured so that signals having the same size are fed in between the lower ends of the vertical radiators 4 and the electrically conductive base surface, which signals are shifted in phase by 360°/4 relative to one another, in each instance.

FIG. 5 shows another embodiment wherein ring line radiator is configured as a closed square line ring having the edge length of λ/4 over the conductive base surface 6, at a distance h above the conductive base surface 6. To produce a continuous line wave on the ring line radiator 2, and for coupling to the ring line radiator 2, the antenna feeder or electromagnetic excitation 3 is structured as a ramp-shaped directional coupling conductor 12 having an advantageous length of essentially or substantially λ/4. The latter is structured essentially or substantially as a linear conductor, which advantageously runs in a plane that contains one side of the ring line radiator 2 and that is oriented perpendicular to the electrically conductive base surface 6. In this connection, the linear conductor, proceeding from the antenna connector 5 situated on the conductive base surface 6, is guided adjacent to one of the corners of the ring line radiator 2 by way of a vertical feed line 4. This linear conductor is spaced apart from ring line radiator 2 by coupling end distance 16, and is guided from there essentially or substantially according to a ramp function, to the base surface 6, approximately below an adjacent corner. This end of the linear conductor is conductively connected with this surface by way of the ground connector 11.

It is possible to produce the adaptation at the antenna connector 5 in simple manner, by way of setting the coupling distance 16. The particular advantage of this arrangement consists in the contact-free coupling of the antenna feeder or excitation 3 to the square-shaped ring line radiator 2, which, according to one embodiment of the invention, allows particularly simple production of the antenna.

FIG. 6 shows another embodiment of an antenna which shows ring line coupling points 7 and wherein antenna feeder or electromagnetic excitation 3 comprises vertical radiators 4 that are of substantially equal length and run toward the conductive base surface 6. These vertical radiators, are connected to a connector of a power distribution network by way of a feed line 22 of equal length. This network on the other hand, is connected with the antenna connector 5. The power distribution network comprises microstrip conductors 30*a*, 30*b*, 30*c* having a length of λ/4 and switched in a chain, formed on conductive base surface 6, whereby their wave resistances—proceeding from a low wave resistance at the antenna connector 5—to which one of the vertical radiators 4 is directly connected, by way of its feed line 22—are stepped up in such a manner so that the signals fed into the ring line radiator 2 at the corners possess the same power and differ in phase by 90°, in each instance, continuously trailing one another.

FIG. 7 shows another embodiment of antennas which comprise arrays comprising ring line coupling points 7 are formed at the ring line radiators 2 of the extended length L, at essentially or substantially similar distances L/N relative to one another. At these points, a vertical radiator 4 is coupled, in each instance, and which extends on the other side to the electrically conductive base surface 6. These vertical radiators are coupled to base surface 6 by way of ground connection points 11. To produce a line wave on the ring line radiator 2 that spreads exclusively in one direction, reactance circuits 13 can be inserted into the vertical radiators 4 at interruption points, to establish the propagation direction of this wave by means of the configuration of their reactance X, and to prevent the propagation of a wave in the opposite direction. With this design, the excitation 3, which can be configured in many varied ways, is indicated in general form.

Ring line radiator 2 and the circular group of the vertical radiators 4 are electromagnetically or galvanically coupled together at the ring line coupling points 7. The antenna parts are coupled with one another so that the two antenna parts are designed and contribute to a circularly polarized field. With this design, ring line radiator 2 acts as an emitting element, which produces a circularly polarized field having a vertical main direction of emission. The electromagnetic field produced by vertical radiators 4 is superimposed on this field. In this connection, the electromagnetic field produced by the circular group of the vertical radiators 4 is also circularly polarized, at a diagonal elevation, with a main emission direction that is essentially or substantially independent of the azimuth. At a low elevation, this field is vertically polarized, and is essentially or substantially also independent of the azimuth.

FIG. 7 describes the resonance structure which is connected with the antenna connector 5 by way of an antenna feeder or excitation 3, so that the line wave on the ring line radiator 2 spreads essentially or substantially only in one direction of rotation, so that a period of the line wave is contained in the direction of rotation of the ring structure.

The ring structure, having N vertical radiators, can be divided into N segments. As a condition for a continuous wave having a period in the direction of rotation, it holds true for the currents I2 and I1 of segments that are adjacent to one another:

$$\underline{I}2=\underline{I}1\cdot\exp(j2\pi/N) \tag{1}$$

It furthermore holds true for the current at the ring line coupling point 7, which flows into the vertical radiator 4:

$$\underline{I}S=\underline{I}1\cdot\exp(j\phi)-\underline{I}2, \tag{2}$$

where $$\phi=2\pi L/(N\lambda) \tag{3}$$

forms the phase rotation over the wave conductors having the length L/N for a segment.

Thus, the current IS must be set, by way of the impedance of vertical radiators 4, together with the reactance X at the foot connection point of vertical radiators 4, so that the following holds true:

$$\underline{I}S=\underline{I}1\cdot[\exp(j2\pi L/(N\lambda))-\exp(j2\pi/N)] \quad (4)$$

Vertical radiators 4, together with the reactances X, form a filter in their equivalent circuit diagram, comprising a serial inductance, a parallel capacitance, and another serial inductance. The parallel capacitance is selected by way of setting the reactances X, so that the filter is adapted to the conductor impedance of the ring-shaped transmission line 1 on both sides. The resonance structure thus comprises N conductor segments having the length L/N and a filter connected with them, in each instance. Each filter brings about a phase rotation A. The length L/N of the conductor segments is then set in such a manner that a phase rotation of $$\Phi=2\pi L/(N\lambda) \quad (5)$$

according to Equation (3) occurs over this conductor segment, which, together with the phase rotation A of the corresponding filter, yields a resulting phase rotation over a segment of $$\Delta\phi+\phi=2\pi/N \quad (6)$$

The electromagnetic wave that spreads clockwise along the ring structure thus experiences a phase rotation of $2\pi$ during a rotation. With this particularly advantageous embodiment of the invention, the possibility therefore exists of configuring the extended length L of the loop antenna 2 to be shorter than the wavelength $\lambda$ by the length-reduction factor $k<1$, so that $L=k*\lambda$ holds true.

By adhering to the conditions indicated in Equation 4 for the current in the vertical radiators 4, according to one embodiment of the invention their design contribution to the circular polarization at a diagonal elevation with an azimuthal all-around characteristic is obtained. In this way, the particular advantage of the main radiation with circular polarization at a diagonal elevation is obtained with one embodiment of the invention. Thus, the antenna is also particularly suitable for reception of signals of low-flying satellites. Furthermore, the antenna can also advantageously be used for such satellite radio systems in which terrestrial, vertically polarized signals are additionally transmitted to support reception.

FIG. 8 is directed towards another embodiment wherein vertical radiators 4 are coupled to the ring line coupling points 7, by way of horizontal radiator elements 14. Horizontal radiator elements 14 can be flexibly used for further formation of the vertical radiation diagram of the antenna. The requirement described above, for a selection of the reactances X to be introduced into the vertical radiators 4, to fulfill the above equations, remains unaffected in this connection.

FIG. 9 shows a low-effort production of a ring line radiator 2, in a square shape. This design shows four ring line coupling points 7 formed at the corners of the square, and vertical radiators 4 connected galvanically there, with a capacitor 15 introduced at the foot point toward the ground connection point 11, in each instance, as a reactance circuit 13. The excitation 3 of this resonance structure can be configured in different ways, and is therefore not contained in FIG. 9.

FIG. 11 shows another embodiment of the feeder or excitation 3 for a ring line radiator 2 having a square shape, this conductor loop is configured in contact-free manner, as a directed, inductively and capacitively coupled conductor loop, as a directional coupler 18. The directional coupling conductor 18 is tapered in shape, and is configured, in similar manner as described in connection with the excitation 3 in FIG. 5, essentially or substantially as a linear conductor, which advantageously runs in a plane that contains one side of the ring line radiator 2, and that is oriented perpendicular to the electrically conductive base surface 6. In this connection, the linear conductor, proceeding from the ground connection points 11 situated on the conductive base surface 6, is guided up to the ring line radiator 2, by way of a short vertical feed line and by way of a ramp function, except for a coupling distance 10, is guided from there back to the conductive base surface by way of a vertical radiator 4, and connected with the antenna connector 5 by way of an adaptation network 25.

In FIG. 12A, one of the vertical radiators 4*a*, with the reactance circuit 13 implemented as a capacitor 15, is connected not with the ground connection point 11 on the electrically conductive base surface 6, but rather with the adaptation network 25, with the connector configured on the plane of the conductive base surface 6, and thus with the antenna connector 5. In order to bring about unidirectionality of the wave propagation on the ring line radiator 2, in this advantageous embodiment of the invention, the wave resistance, with reference to the conductive base surface 6, of the partial piece of the ring line radiator 2, relative to the adjacent ring line coupling point 7*b*, is structured in deviation from the wave resistance of the other partial pieces of the ring line radiator 2. If this wave resistance is suitably selected, the propagation of a line wave in the opposite direction of rotation is suppressed. Configuration of the wave resistance can take place in known manner, for example by means of selecting the effective diameter of the essentially or substantially linear ring line radiator 2, or, as shown as an example, by means of an additional conductor 19 that reduces the wave resistance. For further support of the unidirectionality of the wave propagation on the ring line radiator 2, in FIG. 12*b* another partial piece of the ring line radiator 2, which other piece lies opposite the first piece that has a deviating wave resistance, and has a wave resistance that deviates from the wave resistance of the other partial pieces of the ring line radiator 2, is present.

FIG. 13 shows another embodiment of an antenna which shows a feeder or electromagnetic excitation 3 which is configured by means of partial coupling to one of the vertical radiators 4 at one of the ring line coupling points 7*a*. The unidirectional effect of the electromagnetic excitation 3, with regard to the wave propagation, is provided by means of partial coupling to a vertical radiator 4*a* by way of a coupling conductor 23 that is guided in parallel to part of the ring line radiator 2, and the other end of the coupling conductor 23 is connected to a vertical radiator 4*e*, which runs toward the conductive base surface 6, whereby the latter is connected with the antenna connector 5 by way of an adaptation network 25.

In FIG. 14, the adaptation network 25 is advantageously structured in the form of a high-ohm transmission line laid parallel to the electrically conductive base surface 6, over about ¼ of the wavelength.

For space reasons, it can be necessary to configure the ring line radiator 2 with smaller dimensions, while maintaining the resonance conditions. For this purpose, according to one embodiment of the invention, each section between adjacent ring line coupling points 7 of the ring line radiator 2 can be given the same meander-shaped formation 17 for all the sections, as shown as an example in FIG. 10.

An essential property of an antenna according to one embodiment of the present invention is the possibility of particularly low-effort production. A form of the antenna that is outstandingly advantageous in this regard, having a square ring line radiator 2, is configured similar to that in FIG. 12*b*, in terms of its nature, and shown in FIG. 15. The ring line radiator 2 having the vertical radiators 4*a*, 4*b*, 4*c*, 4*d* can be produced, together with the planar capacitor electrodes 32*a*, 32*b*, 32*c*, 32*d* individually formed at its lower end, for example from a cohesive, punched and shaped sheet-metal part. The wave resistances of the partial pieces of the ring line radiator 2 can also be configured individually, by means of selecting the width of the connecting pieces. The electrically conductive base surface 6 is preferably structured as a conductively coated circuit board. The reactance circuits 13, implemented as capacitors 15, are formed in such a manner that the capacitor electrodes 32*a*, 32*b*, 32*c*, 32*d* are configured by means of interposition of a dielectric panel 33 situated between them and the electrically conductive base surface 6, for coupling three vertical radiators 4*a*, 4*b*, 4*c* to the electrically conductive base surface 6. In order to configure the fourth vertical radiator 4*d* and capacitively couple it to the antenna connector 5, this radiator is configured as a planar counter-electrode 34 insulated from the conductive layer of the circuit board. In particularly low-effort manner, the possibility thus exists of producing the essential dimensions, required for functioning of the antenna, by way of a punched and shaped sheet-metal part, with the advantages of great reproducibility. The sheet-metal part, the dielectric panel 33, and the electrically conductive base surface 6, structured as a circuit board, can be connected with one another, for example, by means of low-effort gluing, and thus without complicated soldering. The connection to a receiver can be implemented in known manner, for example by means of connecting a microstrip line or a coaxial line, proceeding from the antenna connector 5.

In another variant of such an antenna, in FIG. 16, another conductively coated, dielectric circuit board is inserted in place of a dielectric panel 33, between the lower ends of the vertical radiators 4*a*, 4*b*, 4*c*, 4*d* and the electrically conductive base surface 6 structured as a conductively coated circuit board. On the top of the dielectric circuit board, printed planar capacitor electrodes 32*a*, 32*b*, 32*c*, 32*d* are present to form the capacitors 15, which are galvanically connected with the vertical radiators 4*a*, 4*b*, 4*c*, 4*d*, if necessary by means of soldering. The capacitive coupling of three of the vertical radiators 4*a*, 4*b*, 4*c* to the electrically conductive base surface 6 takes place by way of the capacitor electrodes 32*a*, 32*b*, 32*c*. The capacitive coupling of the fourth vertical radiator 4*d* to the antenna connector 5, which is configured as a planar counter-electrode 34 insulated from the conductive layer, is provided by way of the capacitor electrode 32.

In another advantageous embodiment of the invention, the antenna in FIG. 17 is configured similar to that in FIG. 16, whereby the conductive structure, consisting of the ring conductor 2 and the vertical radiators 4 connected with it, is fixed in place by means of a dielectric support structure 36, in such a manner that the dielectric panel 33 is implemented in the form of an air gap.

For the configuration of a multi-band antenna according to one embodiment of the invention, the reactance circuit 13 is configured to be multi-frequent, in such a manner that both the resonance of the ring line radiator 2 and the required running direction of the line wave on the ring line radiator 2 are provided in frequency bands that are separate from one another.

Particularly in vehicle construction, there is often an interest in configuring the visible construction height of an antenna affixed to the vehicle skin to be as low as possible. This wish goes as far as the configuration of a completely invisible antenna, whereby the latter is completely integrated into the vehicle skin. In an advantageous configuration of one embodiment of the invention, the conductive base surface 6, which essentially or substantially runs in a base surface plane E1, as shown in FIGS. 18A and 18B, as an example, with slanted cavity side surfaces 40, is shaped, at the location of the ring line radiator 2, as a conductive cavity 38 that opens toward the top. This cavity 38 is thus an active part of the conductive base surface 6, and consists of a cavity base surface 39 in a base surface plane E2 situated at a distance h1 parallel to and below the base surface plane E1. The cavity base surface 39 is connected with the level part of the conductive base surface 6 by way of the cavity side surfaces 40. The ring line radiator 2 is introduced into the cavity 38 in another horizontal ring line plane E that runs at a height h above the cavity base surface 39.

The surroundings of the ring line radiator 2 with the cavity fundamentally have an effect of constricting the frequency bandwidth of the antenna 1, which is essentially or substantially determined by the cavity distance 41 between the ring line radiator 2 and the cavity 38. For this reason, the conductive cavity base surface 39 should be at least so great that it at least covers the vertical projection surface of the ring line radiator 2 on the base surface plane E2 situated below the conductive base surface. In an advantageous embodiment of the invention, however, the cavity base surface 39 is greater, and selected in such a manner that the cavity side surfaces 40 can be structured as vertical surfaces, and, in this connection, a sufficient cavity distance 41 between the ring line radiator 2 and the cavity 38 is present.

If there is insufficient room for configuring the cavity with vertical cavity side surfaces 40, the base surface plane E2 can be selected to be about as large as the vertical projection surface of the ring line radiator 2 onto the base surface plane E2, and to configure the cavity side surfaces 40 along a contour that is inclined relative to a vertical line. In this connection, the incline of this contour should be selected in such a manner that at the required frequency bandwidth of the antenna 1, a sufficiently large cavity distance 41 is provided between the ring line radiator 2 and the cavity 38 at every location.

FIG. 18B, shows an embodiment wherein an antenna 1 is completely integrated into the vehicle body, in which the ring line plane E runs at approximately the same level as the base surface plane E1, approximately the following advantageous dimensions result for the aforementioned example of SDARS satellite radio, at a frequency of approximately 2.33 GHz in two adjacent frequency bands, each having a bandwidth of 4 MHz, for adherence to the required cavity distance 41 between the ring line radiator 2 and the cavity 38. For this purpose, the incline of the cavity side surfaces 40 is selected, in each instance, in such a manner that at a vertical distance z above the cavity base surface 39, the horizontal distance d between the vertical connection line between ring line radiator 2 and cavity base surface 39 and the closest cavity side surface 40 takes on at least half the vertical distance z. Of course, the frequency bandwidth of the antenna 1 increases, the farther the cavity 38 is open toward the top. If the cavity side surfaces 40 are configured to be perpendicular in the case of adherence to the required cavity distance 41 between the ring line radiator 2 and the cavity 38, as last mentioned, then the required frequency bandwidth is also assured. The same also holds true if the height h of the ring line plane E is greater than the depth of the cavity base surface 39, as shown in FIG. 18*a*. This means that h is greater than h1 and the antenna 1 is not completely integrated into the vehicle body.

Particularly for the formation of combination antennas for multiple radio services, ring line radiators 2 according to one embodiment of the present invention offer the advantage of configurability that particularly saves space. For this purpose, for example, multiple ring line radiators can be configured for the different frequencies of multiple radio services, about a common center Z. Because of their different resonance frequencies, the different ring line radiators have only little influence on one another, so that slight distances between the ring lines of the ring radiators 2 can be configured.

With a ring line radiator with circular polarization and an azimuthal directional diagram, according to one embodiment of the invention, the phase of the emitted electromagnetic remote field rotates with the azimuthal angle of the propagation vector, because of the current wave on the ring line that spreads in a running direction.

In FIG. 19, a ring line radiator 2 according to one embodiment of the invention is surrounded by another ring line radiator 2*a*, which is configured in accordance with the above rules and which also forms a resonance structure and is electrically excited in such a manner that on the ring line, the current distribution of a running line wave occurs in a single direction of rotation, the phase difference of which wave amounts to approximately, substantially or precisely $N*2\pi$ over one rotation, in contrast to the inner ring line radiator 2. In this connection, N is a whole number and amounts to $N>1$. The polarization of this radiator, with an azimuthal all-around emission diagram, is also circular, and the phase of the circular polarization rotates at N=2, because of the distribution of two complete waves on the ring conductor, with double dependence on the azimuthal angle of the propagation vector. In this particularly advantageous embodiment of the invention, the two ring line radiators are combined with the same center Z. Thus, the phase reference points of the two ring line radiators 2, 2*a* have the same coverage, in the common center Z. The outer ring line radiator 2*a* shown in FIG. 19 is electrically excited, for example, by way of two coupling points 7*a*, similarly as in FIG. 2, which are spaced apart at $\lambda/4$.

Because of the corresponding length of the ring line structure, however, in contrast, two complete wave trains of a running wave form at N=2. In the case of superimposition of the reception signals, with suitable weighting and phase relationship of the two ring line radiators 2, 2*a*, a direction antenna having a predetermined azimuthal main direction and elevation can be configured, according to one embodiment of the invention. This is done by means of the different azimuthal dependence of the current phases on the two ring line radiators 2, 2*a*, whereby the radiation is superimposed, in supporting or weakening manner, respectively, in certain regions, as a function of the phasing of the two current waves on the ring line radiators 2, 2*a*, as a function of the azimuthal angle of the propagation vector. By means of combining the signals of the two ring line radiators 2, 2*a* in amplitude-appropriate manner, by way of a controllable phase rotation element 42 and a summation network 44, a main direction of the radiation therefore forms, in advantageous manner, in the azimuthal directional diagram of the combined antenna array, at the directional antenna connector 43, which direction is dependent on the setting of the phase rotation element 39. This property allows advantageous tracking of the main radiation direction in the case of mobile satellite reception, for example.

The method of effect of superimposition of the reception signals is evident from the directional diagram shown in FIG. 22, for an LHCP-polarized satellite signal at a setting of the phase rotation element 42. The main direction in the azimuth, with the low elevation, is marked with an arrow.

In an advantageous embodiments of the invention, the additional ring line radiator 2*a* is also configured as a polygonal or circular closed ring line radiator 2*a* disposed with rotation symmetry about the center Z, running in a horizontal plane having the height ha above the conductive base surface 6. According to the invention, the ring line 2*a* is fed in such a manner that the current distribution of a running line wave forms on it, the phase difference of which wave amounts to approximately, substantially, or precisely $2*2\pi$ over a rotation. By means of the effect of the vertical radiators 4*a* coupled on at the ring line coupling points 7*a*, here again the extended length of the additional ring line radiator 2*a* can be configured to be shorter, by a length-reduction factor $k<1$, than the corresponding double wavelength $\lambda$. In order to reduce the diameter D of the ring line radiators 2, 2*a*, the phase difference of $2\pi$ (ring line radiator 2) or $2*2\pi$ (ring line radiator 2*a*), respectively, on the ring line can take place by means of increasing the line inductance and/or the line capacitance relative to the conductive base surface 6.

In a particularly advantageous embodiment of the additional ring line radiator 2*a*, the latter is configured to be circular or polygonal, with eight coupling points 7*a* disposed equidistant on its circumference, with vertical radiators 4 coupled with them. FIG. 20 shows, as an example, a circular ring line radiator 2*a* having additional reactance circuits 45*a*, . . . , 45*d*, which are introduced into the vertical radiators 4. In the case of These reactance circuits 45*a* . . . 45*d* are coordinated with one another, together with the wave resistances Zf in the ring line sections between the ring line coupling points 7*a*, in such a manner that both the running direction of the running wave in the predetermined direction and the resonance of the ring line radiator 2*a* for the phase condition $2*2\pi$ occur for this wave. This is achieved, in advantageous manner, in that the low-ohm and high-ohm wave resistances alternate with one another along the circumference of the ring line radiator 2, 2*a*. Depending on the length-reduction factor $k<1$ explained above, the ring line sections of the two ring line radiators 2, 2*a* can be selected to be significantly shorter than a quarter wavelength, up to $\lambda/8$. In consecutive ring line sections, large and small inductance values and large and small capacitance values of the ring line sections therefore alternate with one another.

FIG. 21 shows a top view of the directional antenna in FIG. 20, whereby the antenna is formed from a square-shaped ring line radiator 2 and an octagon-shaped additional ring line radiator 2. The ring line coupling points 7 and 7*a* are formed at the corners of the square inner ring and the octagonal outer ring, in each instance. The vertical radiators 4 are connected to them, in each instance. Particularly in the case of mobile satellite reception with only restricted or partly shut-off direct sight to the satellite, it is frequently advantageous, due to signal disappearance that occurs suddenly, to increase the plurality of the reception signals that are available for selection, for example in the sense of a switching diversity method. By means of configuring the summation network 44 as a summation and selection network 44*a*, a separate selection can be made there not only between the reception signals of the two ring line radiators 2, 2*a* but also the weighted superimposition—if applicable with different weightings.

For the production of the additional ring line radiator 2*a*, the same technologies are used, according to the invention, as those described for the production of the ring line radiator 2, for example particularly also in connection with FIGS. 15 to 17.

In the above description, and in the following claims, the term "coupled, or coupled to" when referring to a physical connection generally means connected directly or indirectly thereto, and thus allows for intermediate components to be connected in between.

No language in the specification should be construed as indicating any non-claimed element as essential to the practice of the invention.

The use of the terms "a" and "an" and "the" and similar references in the context of describing the invention, and especially in the context of the following claims, are to be construed to cover both the singular and the plural, unless otherwise indicated herein or clearly contradicted by context.

The terms "comprising," "having," "including," and "containing" are to be construed as open-ended terms and should be construed as "including, but not limited to," unless otherwise indicated or contradicted by context.

The recitation of ranges of values herein are merely intended to serve as a shorthand method of referring individually to each separate value falling within the range, unless otherwise indicated herein, and each separate value is incorporated into the specification as if it were individually recited herein.

In addition, if the following claims contain reference numerals, these reference numerals are only provided as an example, and are not to be construed as forming any limitation of the claims, or to be construed as limiting the claims in any way.

Accordingly, while a few embodiments of the present invention have been shown and described, it is to be understood that many changes and modifications may be made thereunto without departing from the spirit and scope of the invention as defined in the appended claims.

What is claimed is:

1. An antenna for the reception of circularly polarized satellite radio signals comprising at least one substantially horizontally oriented conductor loop arranged above a conductive ground surface, having an assembly connected to an antenna terminal for electromagnetic excitation of the conductor loop, wherein the conductor loop is designed as a ring circuit emitter and forms a resonance structure and is electrically excitable by electromagnetic excitation in such a way that on the ring circuit with a developed length L the current distribution of a continuous transverse electromagnetic wave occurs in a single direction of rotation, the phase difference of which is exactly $2\pi$ over one revolution, wherein for assistance of the vertically oriented portions of the electromagnetic field, at the circumference of the ring circuit emitter there is at least one vertical emitter running to the conductive ground surface, which vertical emitter is electromagnetically coupled both to the ring circuit emitter and to the electrically conductive ground surface, wherein the ring circuit emitter is formed by a substantially square, closed circuit ring having an edge length of substantially $\lambda/4$ in a substantially horizontal plane at height h above the conductive ground surface, wherein to generate a continuous transverse electromagnetic wave on the ring circuit emitter and for contactless coupling to the ring circuit emitter either a ramp-like directional coupling conductor is provided, which, starting from the antenna terminal which is located on the conductive ground surface via the vertical emitter as far as a coupling distance, leads to one of the corners of the ring circuit emitter, from there coincides with the ground surface approximately below an adjacent corner substantially in a ramp function and is conductively connected to the ground surface via an earth terminal point, and wherein a ramp-like directional coupling conductor is provided, which, starting from an antenna terminal which is located on the conductive ground surface via the vertical emitter as far as a coupling distance, leads to one of the corners of the ring circuit emitter, from there coincides with the ground surface approximately below an adjacent corner substantially in a ramp function and is conductively connected to the ground surface via an earth terminal point.

2. The antenna of claim 1, wherein the ramp-like directional coupling conductor (has a length of substantially $\lambda/4$.

3. The antenna of claim 1, wherein over the circumference of the length (L) of the ring circuit emitter several (N) vertical emitters are coupled to the ring circuit emitter at developed-length intervals (L/N) of equal length remotely from each other via ring circuit coupling points on the one hand, and on the other hand via earth terminal points, and due to the design of the vertical emitters both the resonance of the ring circuit emitter, which is designed as a resonance structure, and the direction of travel of the transverse electromagnetic wave on the ring circuit emitter which is caused by the electromagnetic excitation are assisted.

4. The antenna of claim 1, wherein to produce the resonance of the ring circuit emitter, at least one of the vertical emitters is wired at a point of interruption to a low-loss reactance circuit having the reactance X necessary therefor.

5. The antenna of claim 1, wherein at each corner of the ring circuit emitter is formed a ring circuit coupling point with a vertical emitter which is galvanically connected there, and the emitter is in each case provided with a reactance circuit realised as a capacitance for coupling to the earth terminal point on the electrically conductive ground surface.

6. The antenna of claim 4, wherein one of the vertical emitters is coupled by the reactance circuit which is realized as a capacitance not to the earth terminal point on the electrically conductive ground surface, but to a connection to the matching network formed on the plane of the conductive ground surface, and hence to the antenna terminal.

7. The antenna of claim 4, wherein to assist the unidirectionality of wave propagation on the ring circuit emitter, there is a further section of the ring circuit emitter which is opposite the first section of different impedance, and which has an impedance differing from the impedance of the other sections of the ring circuit emitter, and the reactance circuits are individually matched according to the wave propagation and resonance of the antenna to further assist unidirectionality.

* * * * *